US010235924B2

(12) United States Patent
Qi et al.

(10) Patent No.: US 10,235,924 B2
(45) Date of Patent: Mar. 19, 2019

(54) LIQUID CRYSTAL DISPLAY DEVICE AND METHOD

(71) Applicant: Hisense Electric Co., Ltd., Qingdao (CN)

(72) Inventors: Dongxin Qi, Qingdao (CN); Yufeng Zhang, Qingdao (CN)

(73) Assignees: Hisense Electric Co., Ltd., Qingdao (CN); Hisense USA Corporation, Suwanee, GA (US); Hisense International Co., Ltd., Qingdao (CN)

( * ) Notice: Subject to any disclaimer, the term of this patent is extended or adjusted under 35 U.S.C. 154(b) by 197 days.

(21) Appl. No.: 15/018,400

(22) Filed: Feb. 8, 2016

(65) Prior Publication Data

US 2017/0004785 A1 Jan. 5, 2017

Related U.S. Application Data

(63) Continuation of application No. PCT/CN2015/089055, filed on Sep. 7, 2015.

(30) Foreign Application Priority Data

Jul. 3, 2015 (CN) ..... 2015 1 0388769

(51) Int. Cl.
*G09G 3/36* (2006.01)
*G09G 3/20* (2006.01)

(52) U.S. Cl.
CPC ..... *G09G 3/2092* (2013.01); *G09G 3/3611* (2013.01); *G09G 3/3614* (2013.01); *G09G 2310/08* (2013.01)

(58) Field of Classification Search
CPC ..... G09G 2310/08; G09G 3/2092; G09G 3/3611; G09G 3/3614
(Continued)

(56) References Cited

U.S. PATENT DOCUMENTS 6,028,571 A * 2/2000 Eglit ..... G09G 5/006 345/581
2009/0322737 A1 12/2009 Kim et al.
(Continued)

FOREIGN PATENT DOCUMENTS

CN 101399020 A 4/2009
CN 101669163 A 3/2010
(Continued)

OTHER PUBLICATIONS

Office Action from corresponding Chinese Application No. 201510388769.X dated Jun. 12, 2017 (16 pages).
(Continued)

*Primary Examiner* — Jonathan M Blancha
(74) *Attorney, Agent, or Firm* — Harness, Dickey & Pierce, P.L.C.

(57) ABSTRACT

A liquid crystal displaying method, apparatus and device are provided. For each frame of picture, a timing controller firstly sends N STV signals corresponding to the frame of picture to a gate driver, and the gate driver controls respective rows of TFTs on a liquid crystal panel sequentially according to the N STV signals to be pre-turned on for N times; and the timing controller sends the (N+1)-th STV signal to the gate driver before an end of the first time pre-turning-on of the M-th row of TFTs, and the gate driver control the respective rows of TFTs on the liquid crystal panel sequentially according to the (N+1)-th STV signal to be turned on for the (N+1)-th time, so that the source driver finally charges respective rows of storage capacitors and pre-charge respective rows of storage capacitors of the rows of TFTs pre-turned on.

17 Claims, 11 Drawing Sheets

(58) Field of Classification Search
USPC ..... 345/100
See application file for complete search history.

(56) References Cited

U.S. PATENT DOCUMENTS

| | | | | |
|---|---|---|---|---|
| 2010/0020055 | A1* | 1/2010 | Nose | G02F 1/13476 345/209 |
| 2010/0315403 | A1* | 12/2010 | Kaneyoshi | G09G 3/3614 345/211 |
| 2013/0113849 | A1* | 5/2013 | Park | G09G 3/2037 345/691 |
| 2013/0293529 | A1* | 11/2013 | You | G09G 3/20 345/212 |
| 2015/0070403 | A1* | 3/2015 | Kim | G09G 3/3607 345/690 |

FOREIGN PATENT DOCUMENTS

| | | | |
|---|---|---|---|
| CN | 101826311 | A | 9/2010 |
| CN | 101847374 | A | 9/2010 |
| CN | 102237055 | A | 11/2011 |
| CN | 102402960 | A | 4/2012 |
| CN | 103413532 | A | 11/2013 |
| CN | 104916265 | | 10/2017 |
| JP | 2006079092 | A | 3/2006 |
| KR | 102006006642 | A | 6/2006 |

OTHER PUBLICATIONS

Notification to Grant Patent Right for Invention and Supplementary Search Report from corresponding Chinese Application No. 201510388769.X dated Sep. 1, 2017 (4 pages).

* cited by examiner

The N-th frame

| | | | | | |
|---|---|---|---|---|---|
| + | + | + | ··· | + | + |
| + | + | + | ··· | + | + |
| ··· | ··· | ··· | ··· | ··· | ··· |
| + | + | + | ··· | + | + |
| + | + | + | ··· | + | + |

The (N+1)-th frame

| | | | | | |
|---|---|---|---|---|---|
| - | - | - | ··· | - | - |
| - | - | - | ··· | - | - |
| | ··· | ··· | ··· | ··· | ··· |
| - | - | - | ··· | - | - |
| - | - | - | ··· | - | - |

Frame polarity inversion

The N-th frame

| | | | | | |
|---|---|---|---|---|---|
| + | + | + | ··· | + | + |
| - | - | - | ··· | - | - |
| + | + | + | ··· | + | + |
| - | - | - | ··· | - | - |
| ··· | ··· | ··· | ··· | ··· | ··· |

The (N+1)-th frame

| | | | | | |
|---|---|---|---|---|---|
| - | - | - | ··· | - | - |
| + | + | + | ··· | + | + |
| - | - | - | - | - | - |
| + | + | + | ··· | + | + |
| ··· | ··· | ··· | ··· | ··· | ··· |

Row polarity inversion

The N-th frame

| | | | | | |
|---|---|---|---|---|---|
| + | - | + | - | ··· | + |
| + | - | + | - | ··· | + |
| ··· | ··· | ··· | - | ··· | ··· |
| + | - | + | - | ··· | + |
| + | - | + | - | ··· | + |

The (N+1)-th frame

| | | | | | |
|---|---|---|---|---|---|
| - | + | - | + | ··· | - |
| - | + | - | + | ··· | - |
| ··· | ··· | ··· | + | ··· | ··· |
| - | + | - | + | ··· | - |
| - | + | - | + | ··· | - |

Column polarity inversion

The N-th frame

| | | | | | |
|---|---|---|---|---|---|
| + | - | + | ··· | - | + |
| - | + | - | ··· | + | - |
| ··· | ··· | ··· | ··· | ··· | ··· |
| - | + | - | ··· | + | - |
| + | - | + | ··· | - | + |

The (N+1)-th frame

| | | | | | |
|---|---|---|---|---|---|
| - | + | - | ··· | + | - |
| + | - | + | ··· | - | + |
| ··· | ··· | ··· | ··· | ··· | ··· |
| + | - | + | ··· | - | + |
| - | + | - | ··· | + | - |

Dot polarity inversion

Fig.8

LIQUID CRYSTAL DISPLAY DEVICE AND METHOD

CROSS-REFERENCE TO RELATED APPLICATIONS

This application is a continuation of PCT International Application No. PCT/CN2015/089055 filed Sep. 7, 2015, and claims the benefit and priority of Chinese Patent Application No. 201510388769.X filed Jul. 3, 2015. The entire disclosures of the above-referenced applications are incorporated herein by reference.

FIELD

The present disclosure relates to the field of liquid crystal displays and particularly to a liquid crystal display method, apparatus and device.

BACKGROUND

This section provides background information related to the present disclosure which is not necessarily prior art.

At present, Liquid Crystal Displays (LCDs) have been widely applied to desktop computers, handsets, TV sets, and various office automatization and audio/video devices. The LCD generally includes a Thin Film Transistor (TFT)-type LCD, a Thin Film Diode (TFD)-type LCD, a Ultra Fine Bright (UFB)-type LCD, etc., where the TFT-type LCD is an active matrix-type liquid crystal display, which is a plate capacitor formed by two glass substrates between which liquid crystals are sandwiched, and storage capacitors in the capacitor is charged by TFTs embedded on the lower glass substrate to maintain voltage required for each frame of picture until a next frame of picture is refreshed, where the contents of the frame of picture are determined by the amounts of charges of the storage capacitor.

SUMMARY

This section provides a general summary of the disclosure, and is not a comprehensive disclosure of its full scope or all of its features.

An aspect of the disclosure provides a liquid crystal display device including a processor, a memory, a gate driver, a source driver, a plurality of rows of Thin Film Transistors (TFTs) on a liquid crystal panel, and a plurality of rows of storage capacitors on the liquid crystal panel, wherein:

the memory is configured to store computer readable program codes;

the processor is configured to execute the computer readable program codes stored in the memory to send N start vertical signals corresponding to a frame of picture sequentially to the gate driver, and to send an (N+1)-th start vertical signal corresponding to the frame of picture to the gate driver before an end of the first time pre-turning-on of the M-th row of TFTs on the liquid crystal panel;

the gate driver is configured to control each of the plurality of rows of TFTs on the liquid crystal panel sequentially according to the N start vertical signals to be pre-turned on for N times, and to control each of the plurality of rows of TFTs on the liquid crystal panel according to the (N+1)-th start vertical signal to be turned on sequentially for the (N+1)-th time; and the source driver is configured to finally charge each of the plurality of rows of storage capacitors during each of the plurality of rows of TFTs is turned on for the (N+1)-th time, and to pre-charge each of the plurality of rows of storage capacitors during each of the plurality of rows of TFTs is pre-turned on, wherein N and M represent positive integers more than or equal to 1, and less than the total number of rows on the liquid crystal panel.

Another aspect of the disclosure provides a liquid crystal display timing control apparatus including a processor and a memory, where computer readable program codes are stored in the memory and executed by the processor:

to send N start vertical signals corresponding to a frame of picture sequentially to a gate driver so that the gate driver controls each of a plurality of rows of Thin Film Transistors (TFTs) on a liquid crystal panel sequentially according to the N start vertical signals to be pre-turned on for N times, and a source driver pre-charges each of a plurality of rows of storage capacitors during each of the plurality of rows of TFTs is pre-turned on; and to send an (N+1)-th start vertical signal corresponding to the frame of picture to the gate driver before an end of the first time pre-turning-on of the M-th row of TFTs on the liquid crystal panel, so that the gate driver controls each of the plurality of rows of TFTs on the liquid crystal panel according to the (N+1)-th start vertical signal to be turned on sequentially for the (N+1)-th time, so the source driver finally charges each of the plurality of rows of storage capacitors during each of the plurality of rows of TFTs is turned on for the (N+1)-th time, wherein N and M represent positive integers more than or equal to 1, and less than the total number of rows on the liquid crystal panel.

A further aspect of the disclosure provides a liquid crystal displaying method including:

sending, by a timing controller, N start vertical signals corresponding to a frame of picture sequentially to a gate driver so that the gate driver controls respective rows of Thin Film Transistors (TFTs) on a liquid crystal panel sequentially according to the N start vertical signals to be pre-turned on N times, and a source driver pre-charges respective rows of storage capacitors while the respective rows of TFTs are pre-turned on; and sending, by the timing controller, an (N+1)-th start vertical signal corresponding to the frame of picture to the gate driver before initial pre-turning-on of the M-th row of TFTs on the liquid crystal panel is completed, so that the gate driver control the respective rows of TFTs on the liquid crystal panel according to the (N+1)-th start vertical signal to be turned on sequentially the (N+1)-th time, so the source driver finally charges the respective rows of storage capacitors while the respective rows of TFTs are turned on the (N+1)-th time, wherein N and M represent positive integers more than or equal to 1, and less than the total number of rows on the liquid crystal panel.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 8 is a diagram of respective polarity inversion schemes of the liquid crystal panel;

Corresponding reference numerals indicate corresponding parts or features throughout the several views of the drawings.

DETAILED DESCRIPTION

Example embodiments will now be described more fully with reference to the accompanying drawings.

Figure 1:
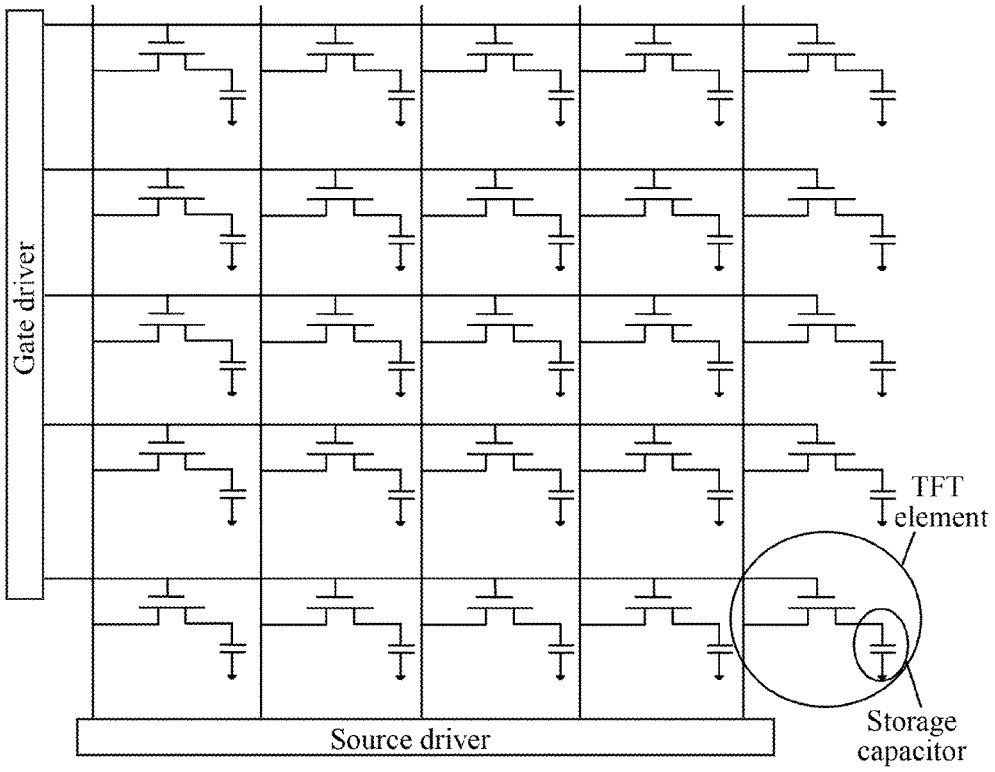
FIG. 1 is an equivalent circuit diagram of a liquid crystal panel.

A TFT-type LCD includes thin film transistors arranged on respective pixels, where the plurality of TFTs constitute a TFT liquid crystal panel. FIG. 1 illustrates an equivalent circuit diagram of the liquid crystal panel, where a TFT element composed of one of the TFTs and a storage capacitor represents a pixel, and a drive system drives a plurality of rows of TFTs to be turned on sequentially to thereby charge a plurality of rows of storage capacitors sequentially.

Figure 2:
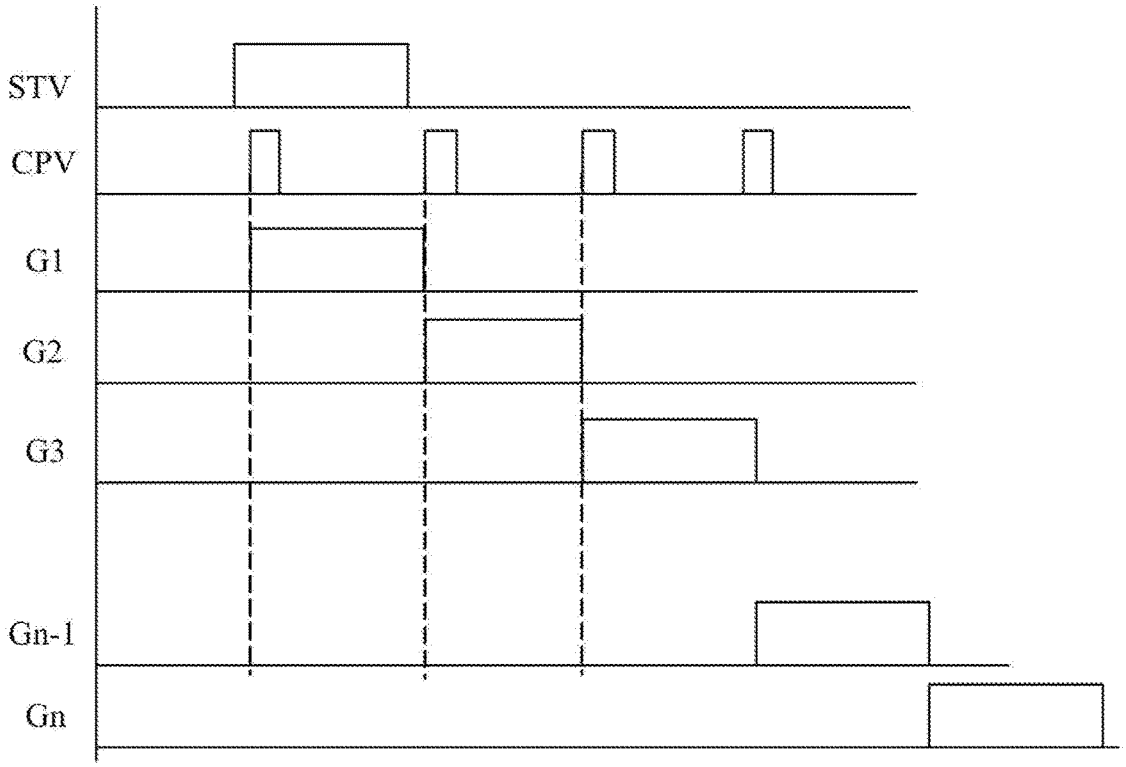
FIG. 2 is a drive timing diagram of a general liquid crystal panel.

The drive system of the TFT-type LCD generally includes three components, i.e., a signal source, a Time Controller (Tcon), and a liquid crystal panel. The liquid crystal panel includes a panel substrate, a source driver, and a gate driver, where as illustrated in FIG. 1, the source driver is connected with sources of respective columns of TFTs, and the gate driver is connected with gates of the respective rows of TFTs. The signal source is configured to generate an image signal to provide image information to the Tcon; and the Tcon is configured to output a control signal, and data signals as required for the liquid crystal panel, e.g., data signals required for the source driver, Clock Pulse Vertical (CPV) signals required for the gate driver, Start Vertical (STV) signals, etc., where the CPV is a clock signal to control each row of TFTs to be turned on, and the STV is configured to control transmission of each frame of picture. FIG. 2 is a drive timing diagram of a general liquid crystal panel. If there are n rows in the liquid crystal panel, then there may be corresponding n gate drive signals, i.e., G1, G2, . . . , Gn−1, and Gn. As illustrated in FIG. 2, when the high level of the STV signal arrives, each row of drive signals corresponds to a CPV, and each row of drive signals is output sequentially at a periodicity of the CPV to refresh the amounts of charges in the storage capacitors of each row of liquid crystal molecules respectively. For a liquid crystal panel with n horizontal lines, TFTs in each row are turned on for only at most 1/n of the refresh time of the frame of picture, so if there are more pixels in a larger number n of rows on the liquid crystal panel, then the storage capacitors in each row of pixels on the liquid crystal panel can be charged for a shorter period of time at a given refresh frequency.

Along with higher and higher resolutions of liquid crystal displays, i.e., more and more pixels of liquid crystal panels, as required by consumers, if a video is played at the same frequency, then each row of storage capacitors may be charged for a shorter period of time due to a larger number of pixels, so if the number of rows is increased to some extent, then each row of storage capacitors may be charged insufficiently, thus degrading the quality of picture on the liquid crystal display seriously.

As can be apparent from the analysis above, if there are a larger number of pixels on the liquid crystal panel, then each row of storage capacitors on the liquid crystal panel will be charged for a shorter period of time, so if the number of rows is increased to some extent, then each row of storage capacitors may be charged insufficiently, thus degrading the quality of picture on the liquid crystal display seriously, primarily because an angle at which the liquid crystal molecules are flipped is determined by the voltage across the storage capacitors on the respective pixels so that if the angle at which the liquid crystal molecules are flipped doesn't meet the requirement for the frame of picture to be displayed, then the quality of picture will be degraded. In view of this, the disclosure proposes a liquid crystal displaying method, apparatus and device based on the perspective of how to raise the voltage across the storage capacitors on the respective pixels.

Figure 3:
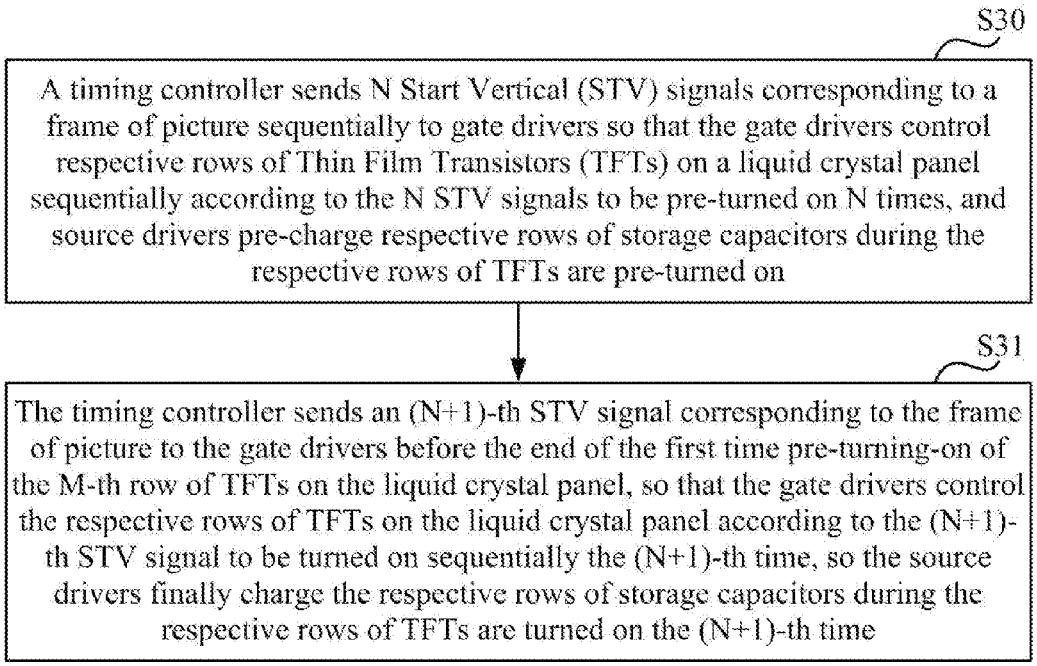
FIG. 3 is a schematic flow chart of a liquid crystal displaying method according to a first embodiment of the disclosure.

FIG. 3 illustrates a schematic flow chart of a liquid crystal displaying method according to a first embodiment of the disclosure. As illustrated in FIG. 3, the liquid crystal displaying method includes:

S30. A timing controller sends N Start Vertical (STV) signals corresponding to a frame of picture sequentially to a gate driver so that the gate driver controls respective rows of Thin Film Transistors (TFTs) on a liquid crystal panel sequentially according to the N STV signals to be pre-turned on for N times, and the source driver pre-charges respective rows of storage capacitors during the respective rows of TFTs are pre-turned on.

S31. The timing controller sends an (N+1)-th STV signal corresponding to the frame of picture to the gate driver before the end of the first time pre-turning-on of the M-th row of TFTs on the liquid crystal panel, so that the gate driver controls the respective rows of TFTs on the liquid crystal panel according to the (N+1)-th STV signal to be turned on sequentially for the (N+1)-th time, so the source driver finally charges the respective rows of storage capacitors during the respective rows of TFTs are turned on for the (N+1)-th time, where N and M represent positive integers more than or equal to 1, and less than the total number of rows on the liquid crystal panel.

In this embodiment, the liquid crystal displaying method is performed by the Timing Controller (Tcon). The timing controller is connected with a signal source and the liquid crystal panel, and configured to generate from image information provided by the signal source a control signal, and data signals as required for the liquid crystal panel, for example, to provide required latch signals (TPs) for the source driver and output enable signals (polarity inversion signals (POLs) for source driver), and to provide the gate driver with required Clock Pulse Vertical (CPV) signals, Start Vertical (STV) signals, scan driver Output Enable (OE) signals, etc. The TP is configured to control each row of data information to be latched and output, for example, the TP signal at a high level controls a row of data to be latched into a row memory, and the TP signal at a low level controls the row of data to be discharged to charge the liquid crystal capacitors, and the POL is configured to control liquid crystal molecules to be inverted in polarity.

Particularly in this embodiment, the gate driver start to control the respective rows of TFTs on the liquid crystal panel to be turned on sequentially, upon reception of the STV signal, and the gate driver is driven by the (N+1) STV signals to control the respective rows of TFTs to be cyclically turned on the (N+1) times, where (N+1) turning-on periods of the respective rows of TFTs are intersected and concurrent. During the first N STV signals, the source driver may or may not receive the data signals sent by the Tcon, and the data signals received by the source driver may be real data signals of the frames of pictures, or pre-processed data signals determined by the Tcon according to the grayscales of the frames of pictures, or pre-processed data signals determined by the Tcon according to the numbers of times that the respective rows of TFTs are turned on during the respective frames of pictures, periods of time for which they are turned on each time, and their real data signals.

The timing controller in this embodiment sends the (N+1) STV signals to the gate driver before each frame of picture is displayed, so that for each frame of picture, the gate driver controls the respective rows of TFTs on the liquid crystal panel to be turned on at least (N+1) times, and the source driver can charge the respective rows of storage capacitors at least (N+1) times. The source driver pre-charges the respective rows of storage capacitors while the respective rows of TFTs are pre-turned on for the first N times, and the source driver finally charges the respective rows of storage capacitors while the respective rows of TFTs are turned on for the (N+1)-th time, so that the frame of picture is displayed. The source driver can supplement or correct the amounts of charges of the storage capacitors during the source driver finally charge the respective rows of storage capacitors. By way of an example, if the amount of charges in a pre-charged storage capacitor of some pixel on the liquid crystal panel is more than the amount of charges required for the pixel to display the current frame of picture, then the amount of charges in the storage capacitor of the pixel can be discharged by the finally charging of source driver so that the amount of charges in the storage capacitor of the pixel will finally be satisfactory to the current frame of picture to be displayed. Correspondingly if the amount of charges in a pre-charged storage capacitor of some pixel on the liquid crystal panel is less than the amount of charges required for the pixel to display the current frame of picture, then the storage capacitor of the pixel can be further charged by the finally charging of source driver so that the amount of charges in the storage capacitor of the pixel finally meet the requirement for the current frame of picture to be displayed.

In order to describe more intuitively the liquid crystal displaying method according to this embodiment, this method will be further described below with reference to a liquid crystal panel drive timing diagram according to this embodiment. Firstly as can be apparent from FIG. 2, a general liquid crystal panel is driven as illustrated in FIG. 2 particularly as follows: in order to start transmission of a frame of picture, the timing controller sends a STV signal to gate driver, and upon reception of the STV signal, i.e., upon arrival of a CPV signal at a first high level, the gate driver output a signal G1 at a high level to the first row of TFTs on the liquid crystal panel to control the first row of TFTs to be turned on, so that the source driver charges the storage capacitors of the first row of respective pixels; upon arrival of the CPV signal at a second high level, the gate driver output a signal G2 at a high level to the second row of TFTs on the liquid crystal panel to control the second row of TFTs to be turned on, and change G1, output to the first row of TFTs, to a low level to turn off the first row of TFTs, so that the source driver charges the storage capacitors of the second row of respective pixels; and so on until the respective rows of storage capacitors on the liquid crystal panel are charged row by row. As can be apparent from the analysis above, a period of time for which each row of TFTs are turned on is dependent upon the total number of rows on the liquid crystal panel, and if there are N rows on the liquid crystal panel, and each frame of picture is refreshed at a frequency f, then the period of time for which each row of TFTs is turned on is 1/(N*f), so the period of time for which each row of TFTs is turned on may be shorter with a larger number of rows on the liquid crystal panel; and as can be apparent from the TFT elements in FIG. 1, if the TFTs are turned on for a shorter period of time, then the source driver may charge the storage capacitors through the TFTs for a shorter period of time, and there may be a smaller amount of charges on the storage capacitors, thus resulting in the problem of insufficient charging.

Unlike driving of the general liquid crystal panel in FIG. 2, the timing controller in this embodiment sends N STV signals to the gate driver until each frame of picture is displayed, where N is more than 1, and a process of charging the respective rows of storage capacitors in this liquid crystal displaying method will be described below in details with reference to FIG. 4 taking N=1 as an example. The same description will apply to N more than 1.

Figure 4:
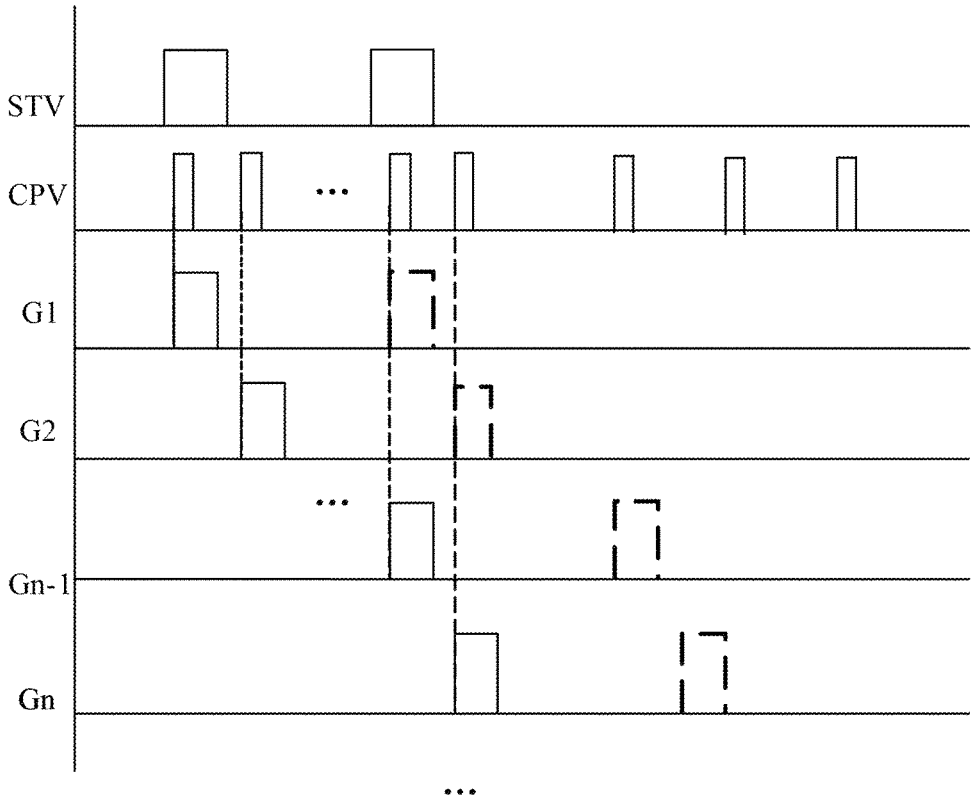
FIG. 4 is a drive timing diagram of a liquid crystal panel according to an embodiment of the disclosure.

FIG. 4 is a drive timing diagram of a liquid crystal panel according to an embodiment of the disclosure. If there are m rows on the liquid crystal panel, then there will be corresponding m gate drive signals G1, G2, . . . , Gn−1, Gn, Gn+1, . . . , Gm. Particularly for each frame of picture, the timing controller firstly sends a STV signal STV1 to the gate driver, and thereafter upon reception of the STV1, i.e., upon arrival of a CPV signal at a first high level, the gate driver outputs a signal G1 at a high level to the first row of TFTs on the liquid crystal panel to control the first row of TFTs to be pre-turned on; upon arrival of the CPV signal at a second high level, the gate driver outputs a signal G2 at a high level to the second row of TFTs on the liquid crystal panel to control the second row of TFTs to be pre-turned on, and change G1, output to the first row of TFTs, to a low level to turn off the first row of TFTs; and so on until the gate driver controls the respective rows of TFTs on the liquid crystal panel to be pre-turned on row by row, and the source driver pre-charge the respective rows of storage capacitors while the respective rows of TFTs are pre-turned on.

If the M-th CPV signal is detected before the end of pre-turning-on of the M-th row of TFTs on the liquid crystal panel, that is, after the gate driver receives the STV1 and detect the M-th CPV signal, then the timing controller sends a second STV signal STV2 to the gate driver, and at this time the Tcon also synchronizes data signals corresponding to the frame of picture to the source driver, so upon arrival of the (M+1)-th CPV signal, the gate driver may be controlled by the STV1 and the STV2 to output a signal Gm+1 and the signal G1 at high levels respectively to the (M+1)-th row and the first row of TFTs on the liquid crystal panel concurrently to control the (M+1)-th row and the first row of TFTs to be turned on concurrently, and change GM, output to the M-th row of TFTs, to a low level to turn off the M-th row of TFTs, and at this time, the source driver can finally charges the first row of storage capacitors according to the received data signals so that the voltage across the storage capacitors on the first row of respective pixels is satisfactory to the requirement for displaying the frame of picture, and the corresponding frame of picture is displayed. In the meantime, the source driver pre-charges the (M+1)-th row of storage capacitors using the first row of data signal. Upon arrival of the (M+2)-th CPV signal, the gate driver is controlled by the STV1 and the STV2 to output a signal GM+2 and the signal G2 at high levels respectively to the (M+2)-th row and the second row of TFTs on the liquid crystal panel concurrently to control the (M+2)-th row and the second row of TFTs to be turned on concurrently, and change GM+1 and G1, output to the (M+1)-th row and the first row of TFTs, to low levels to turn off the (M+1)-th row and the first row of TFTs, and at this time, the source driver can finally charge the second row of storage capacitors according to the received data signals so that the frame of picture is displayed in the second row, and in the meantime, the source driver pre-charges the (M+2)-th row of storage capacitors using the second row of data signal; and so on until the source driver finally charges the respective rows of storage capacitors on the liquid crystal panel, and also pre-charge the (M+1)-th row and the respective succeeding rows of storage capacitors on the liquid crystal panel, according to the data signals corresponding to the frame of picture, so that the frame of picture is displayed. The Tcon controls the respective rows of storage capacitors on the liquid crystal panel to be charged twice to prolong the periods of time for which the respective rows of storage capacitors are charged, thus making the voltage across the respective rows of storage capacitors satisfactory to the requirement for displaying the frame of picture, as much as possible.

As can be apparent from the analysis above, while the (M+1)-th row and the respective succeeding rows of TFTs are pre-turned on, the source driver pre-charges the respective rows of storage capacitors according to the real data signals of the respective rows of TFTs turned on at the same time as the respective rows of TFTs, for example, the pre-charge voltage of the (M+1)-th row is the final charge voltage of the first row, the pre-charge voltage of the (M+2)-th row is the final charge voltage of the second row, etc. Since the Tcon may or may not send the data signals to the source driver before the (N+1)-th STV signal arrives, correspondingly the respective rows of storage capacitors may or may not be pre-charged before the M-th row. In order to enable the respective rows of storage capacitors to be charged at least twice, the timing controller can send pre-processed data signals corresponding to the frame of picture to the source driver after S30 in this embodiment, so that the source driver pre-charges the first M rows of storage capacitors on the liquid crystal panel for N times according to the pre-processed data signals, which may or may not be the same as the data signals corresponding to the frame of picture.

It shall be noted that since there are parasitic capacitors in the TFTs per se, the parasitic capacitors are arranged in parallel with the storage capacitors, so the parasitic capacitors in parallel with the storage capacitors also are charged together with the storage capacitors, that is, the parasitic capacitors are also charged at least twice together with the storage capacitors in the respective embodiments of the disclosure.

In the liquid crystal displaying method according to this embodiment, for each frame of picture, the timing controller firstly sends N STV signals corresponding to the frame of picture to the gate driver, the gate driver controls the respective rows of TFTs on the liquid crystal panel sequentially according to the N STV signals to be pre-turned on for N times, and the source driver pre-charges the respective rows of storage capacitors during the respective rows of TFTs are pre-turned on, where the timing controller sends the (N+1)-th STV signal of the frame of picture to the gate driver before the end of the first time pre-turning-on of the M-th row of TFTsd, and the gate driver controls the respective rows of TFTs on the liquid crystal panel sequentially according to the (N+1)-th STV signal to be turned on for the (N+1)-th time, so that the source driver finally charges the respective rows of storage capacitors according to the data signals corresponding to the frame of picture; and in this liquid crystal displaying method, the respective rows of storage capacitors on the liquid crystal panel are charged at least twice until the frame of picture is displayed, thus prolonging the periods of time for which the respective rows of storage capacitors on the liquid crystal panel are charged, to thereby make the amounts of charges across the respective rows of storage capacitors satisfactory to the requirement for displaying the frame of picture, as much as possible so as to improve the quality of picture on the liquid crystal display.

Figure 5:
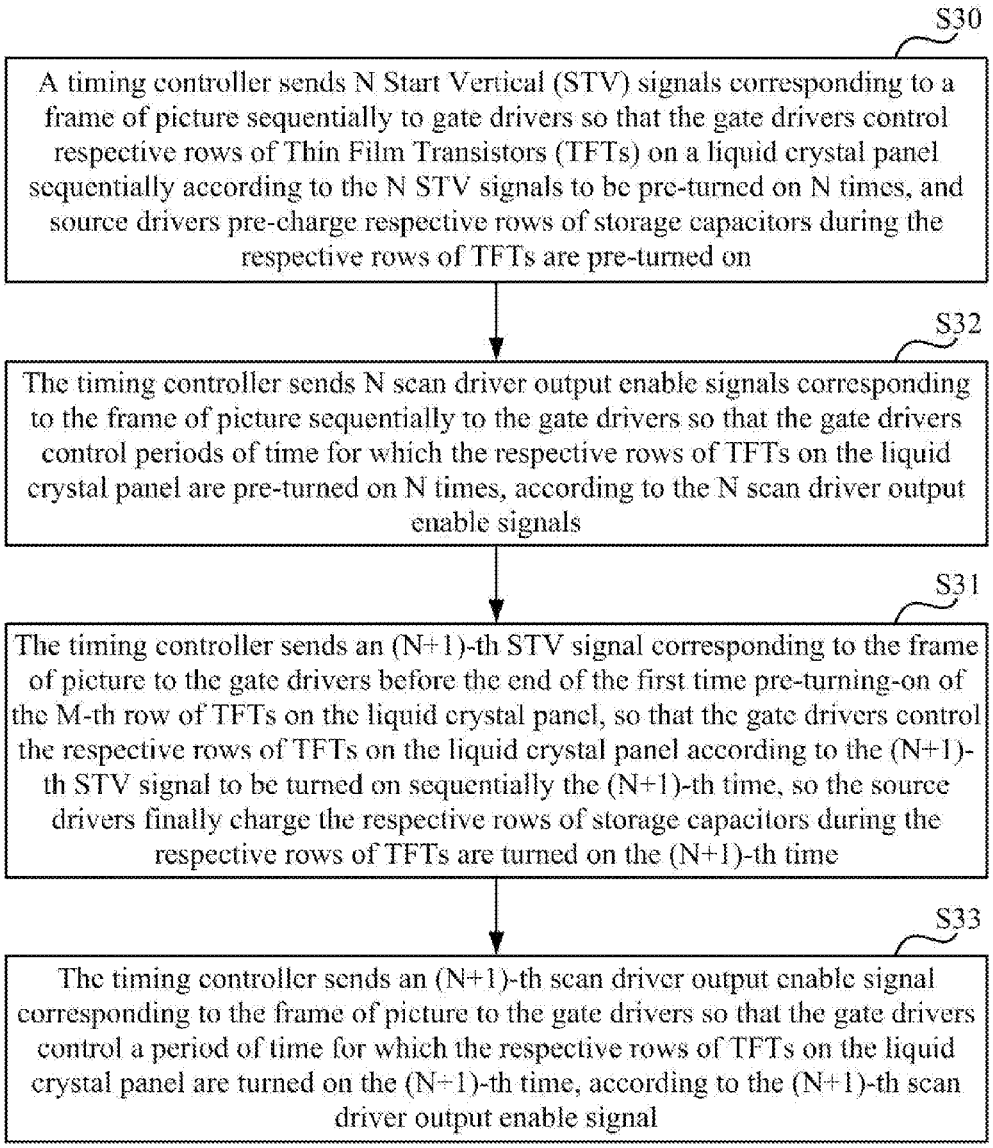
FIG. 5 is a schematic flow chart of another liquid crystal displaying method according to a second embodiment of the disclosure.

As can be apparent from the analysis above, for each frame of picture, Tcon controls the respective rows of TFTs on the liquid crystal panel to be turned on at least twice, to thereby prolong the periods of time for which the respective rows of storage capacitors on the liquid crystal panel are charged, and in a real application, after the respective rows of storage capacitors are charged twice, in order to make the final amounts of charges across the respective rows of storage capacitors satisfactory to the requirement for displaying the frame of pictured, as much as possible, the amounts of charges in the respective rows of storage capacitors can be further controlled accurately, where the amounts of charges in the storage capacitors can be controlled by controlling the turn-on time for which the respective rows of TFTs are turned on each time, and a process of controlling the amounts of charges in the respective rows of storage capacitor by controlling the turn-on time for which the respective rows of TFTs are turned on each time will be described below in details with reference to FIG. 5.

FIG. 5 is a schematic flow chart of another liquid crystal displaying method according to a second embodiment of the disclosure. As illustrated in FIG. 5, further to the method illustrated in FIG. 3 above, after S30, the liquid crystal displaying method according to this embodiment further includes:

S32. The timing controller sends N scan driver output enable signals corresponding to the frame of picture sequentially to the gate driver so that the gate driver controls periods of time for which the respective rows of TFTs on the liquid crystal panel are pre-turned on for N times, according to the N scan driver output enable signals.

Correspondingly after S31, the liquid crystal displaying method according to this embodiment further includes:

S33. The timing controller sends an (N+1)-th scan driver output enable signal corresponding to the frame of picture to the gate driver so that the gate driver controls a period of time for which the respective rows of TFTs on the liquid crystal panel are turned on the (N+1)-th time, according to the (N+1)-th scan driver output enable signal.

In this embodiment, the Tcon further sends N OE signals to the gate driver after sending the N STV signals to the gate driver, where if the N OE signals are identical in width, then only one OE signal may be sent to the gate driver; or the Tcon can send an OE signal to the gate driver each time a STV signal is sent to the gate driver. This embodiment will not be limited in this regard. Particularly for each frame of picture, OE signals corresponding to different STV signals may or may not be identical in width, and during each STV signal, the OE signals corresponding to the respective rows of TFTs may or may not be identical in width. This embodiment will not be limited in this regard.

Particularly in this embodiment, for each frame of picture, the Tcon further sends the OE signals to the gate driver after sending the STV signals to the gate driver, so that the gate driver further controls the periods of time for which the respective rows of TFTs are turned on each time, according to the corresponding OE signals after controlling the respective rows of TFTs to be turned on, to thereby control the periods of time for which the respective rows of storage capacitors are charged each time by the source driver, so as to make the amounts of charges across the respective rows of storage capacitors satisfactory to the frame of picture to be displayed, as much as possible.

As can be appreciated, in order to further control the periods of time for which the storage capacitors are charged each time, as for the same STV signal, the Tcon can further send different OE signals for different rows to the gate driver so that the periods of turn-on time of different rows of TFTs are different, that is, the different rows of storage capacitors are charged for different periods of time, in the same periodicity of the STV signal.

In the liquid crystal displaying method according to this embodiment, for each frame of picture, the timing controller firstly sends N STV signals corresponding to the frame of picture to the gate driver, the gate driver controls the respective rows of TFTs on the liquid crystal panel sequentially according to the N STV signals to be pre-turned on for N times, and the source driver pre-charge the respective rows of storage capacitors during the respective rows of TFTs are pre-turned on, where the timing controller sends the (N+1)-th STV signal of the frame of picture to the gate driver before the first time pre-turning-on of the M-th row of TFTs is completed, and the gate driver control the respective rows of TFTs on the liquid crystal panel sequentially according to the (N+1)-th STV signal to be turned on the (N+1)-th time, so that the source driver finally charges the respective rows of storage capacitors according to the data signals corresponding to the frame of picture. In this liquid crystal display timing control apparatus, the respective rows of storage capacitors on the liquid crystal panel are charged at least twice until the frame of picture is displayed, thus prolonging the periods of time for which the respective rows of storage capacitors on the liquid crystal panel are charged, to thereby make the amounts of charges across the respective rows of storage capacitors satisfactory to the frame of picture to be displayed, as much as possible so as to improve the quality of picture on the liquid crystal display.

Figure 6:
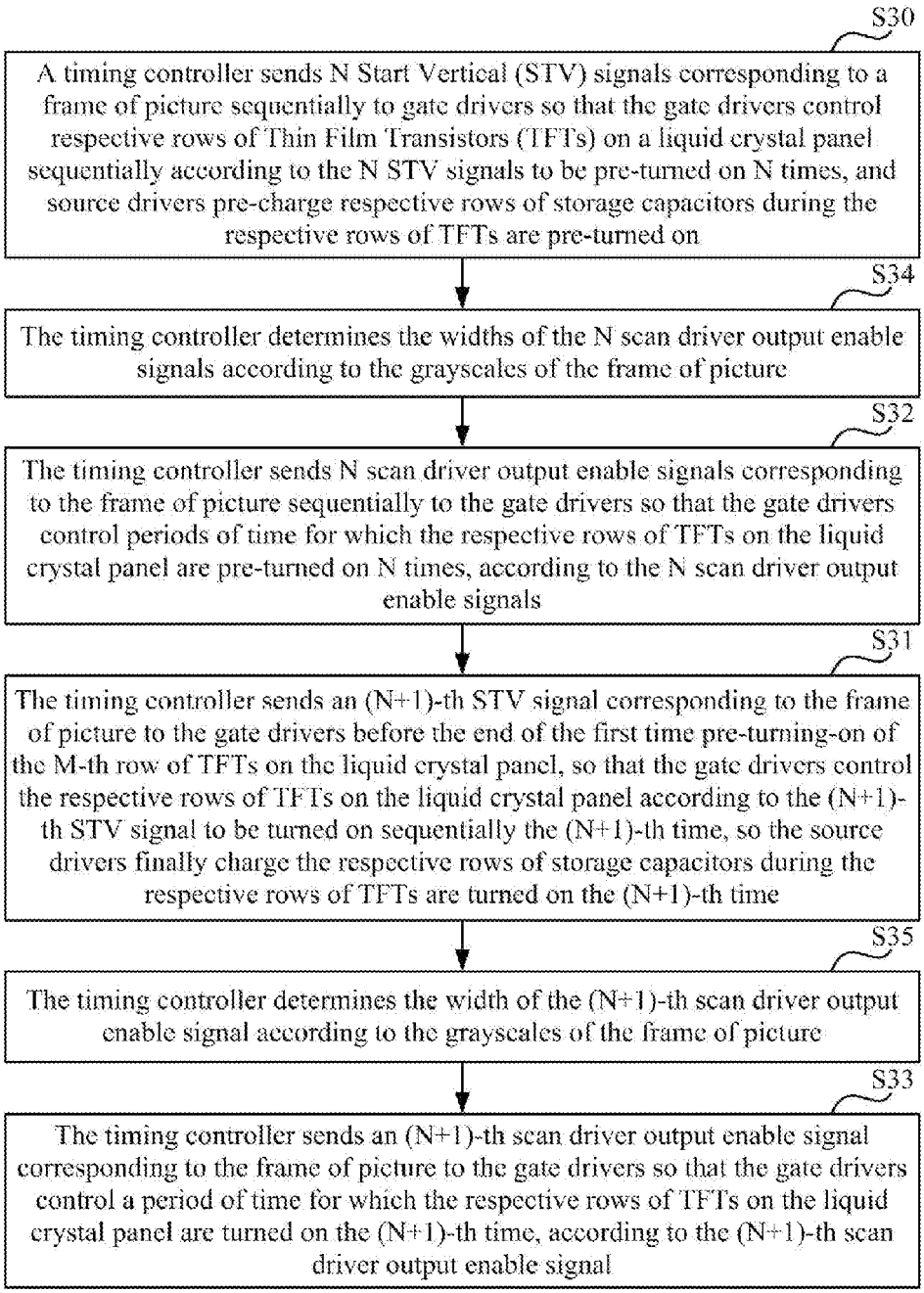
FIG. 6 is a schematic flow chart of a further liquid crystal displaying method according to a third embodiment of the disclosure.

Furthermore in order to control more precisely the periods of time for which the respective rows of TFTs on the liquid crystal panel are turned on, to thereby control the amounts of charges charged by the source driver onto the respective rows of storage capacitors, so as to make the amounts of charges across the respective rows of storage capacitors satisfactory to the frame of picture, the widths of the OE signals above can be further set according to the grayscales of the respective frame of picture, and another liquid crystal displaying method according to an embodiment of the disclosure will be described below with reference to FIG. 6.

FIG. 6 is a schematic flow chart of a further liquid crystal displaying method according to a third embodiment of the disclosure. As illustrated in FIG. 6, further to the method illustrated in FIG. 5, before S32, the liquid crystal displaying method further includes:

S34. The timing controller determines the widths of the N scan driver output enable signals according to the grayscales of the frame of picture.

Correspondingly before S33, the liquid crystal displaying method further includes:

S35. The timing controller determines the width of the (N+1)-th scan driver output enable signal according to the grayscales of the frame of picture.

Particularly the Tcon can determine the final amounts of charges required in the storage capacitors of the respective pixels on the liquid crystal panel, according to the grayscales of the current frame of picture, to thereby set reasonably the widths of the respective OE signals so as to make the amounts of charges in the storage capacitors of the respective pixels consistent with the amounts of charges required to display the frame of picture, as much as possible at the end of pre-charging and final charging.

In the liquid crystal displaying method according to this embodiment, the Tcon determines the widths of the OE signals according to the grayscales of the current frame of picture to thereby control precisely the amounts of charges in the storage capacitors of the respective pixels so as to further improve the quality of picture on the liquid crystal display.

Moreover as can be apparent from FIG. 1 and FIG. 4 together, if there are K TFTs per row on the liquid crystal panel, then for each frame of picture, before the Tcon sends the STV2 signal to the gate driver, upon arrival of each CPV signal, the gate driver controls K TFTs to be turned on; and after the Tcon sends the STV2 signal to the gate driver, and before pre-charging of the last row on the liquid crystal panel for the frame of picture is completed, upon arrival of each CPV signal, the gate driver controls 2K TFTs to be turned on. Moreover as can be apparent from FIG. 1, the same source drive signal is applied to 2K TFTs which are turned on each time, that is, the same voltage is applied to the respective columns of TFTs to charge their respective storage capacitors; and in this embodiment, the source driver output the data signals at the substantially same instances of time as the gate driver, i.e., upon reception of the STV signals, where the instances of time vary sequentially with the frequencies of the CPV signals, and in order to guarantee a final display effect of the frame of picture, the data signals applied by the source driver to the respective rows of storage capacitors will be the real data signals corresponding to the frame of picture while the respective rows of TFTs are finally turned on, so when the gate driver output again the drive signal G1 of the first row of TFTs after the timing controller outputs the (N+1)-th STV signal, the charge voltage applied by the source driver to the sources of the TFTs is the voltage corresponding to the frame of picture in the first row, and at this time, the storage capacitors of a row of TFTs, which are turned on at the same time as the first row of TFTs are pre-charged by the voltage of the frame of picture in the first row while the first row of storage capacitors are finally charged by that voltage.

Then in this embodiment, if the amounts of charges in the respective rows of storage capacitors are increased by charging the respective rows of storage capacitors at least twice, then the storage capacitors of the rows of TFTs, which are turned on at the same time as the respective rows of TFTs shall have the same charge polarities. By way of an example, if the first row and the L-th row of TFTs are turned on concurrently, then the storage capacitors on the first row and the L-th row of pixels shall have the same polarity for the same frame of picture. An equivalent circuit of a pixel will be described below as an example.

Figure 7:
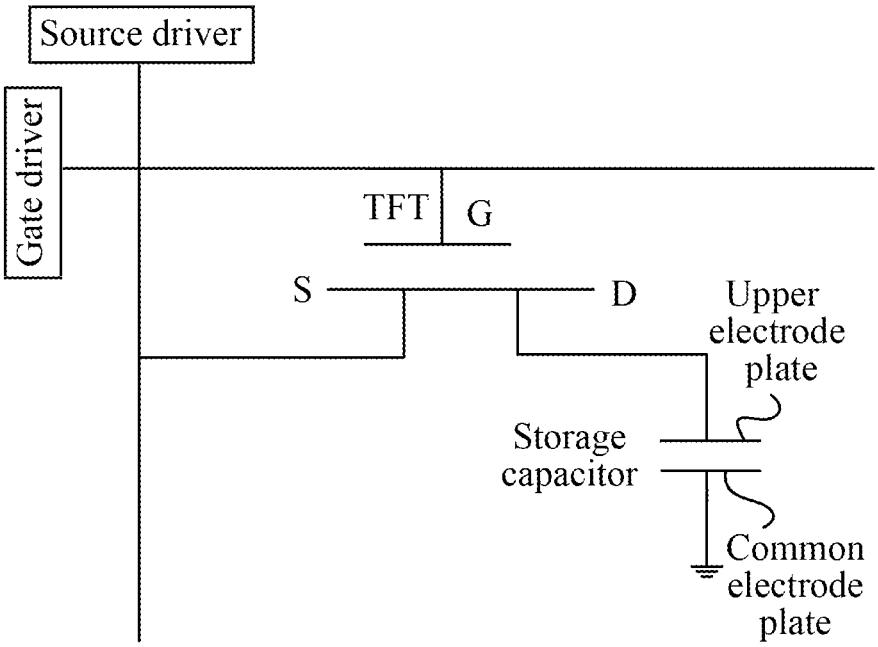
FIG. 7 is an equivalent circuit diagram of a pixel.

FIG. 7 illustrates an equivalent circuit diagram of a pixel. If the voltage on an upper electrode plate of a storage capacitor in FIG. 7 is higher than a common electrode plate, then it indicates that liquid crystal molecules of the pixel are flipped upward and represented as "+", and if the voltage n of an upper electrode plate of a storage capacitor is lower than the common electrode plate, then it indicates that the liquid crystal molecules of the pixel are flipped downward and represented as "−".

By way of an example, if after the TFT in FIG. 7 has been charged, the voltage of the storage capacitor is positive on the lower electrode plate and negative on the upper electrode plate, and at this time, the liquid crystal molecules of the pixel are flipped downward; and after the next time the TFT has been charged, the voltage of the storage capacitor is negative on the lower electrode plate and positive on the upper electrode plate, then it indicates that the charge polarity of the second time is opposite to the charge polarity of the first time. By way of an example, if the flipped angle at which the liquid crystal molecules are controlled by the voltage of 1V is 10 degrees)(°), for example, the voltage across the storage capacitor is −2V after the end of the first time charging, and at this time, the liquid crystal molecules of the pixel are flipped downward at 20°; and the voltage across the storage capacitor is +3V after the end of the second time charging, then the charge voltage across the storage capacitor is +1V after the two times of charging are completed, so the liquid crystal molecules of the pixel are finally flipped upward at 10°, and as compared with the liquid crystal molecules after the first time of charging is completed, the liquid crystal molecules are finally flipped in a different direction and at a smaller angle than the angle after the first time of charging is completed. As can be apparent from the analysis above, if the charge polarities of the storage capacitor are different when the TFT is turned on the first time and the second time respectively, then the two times of charging may deteriorate the flipping of the liquid crystal molecules of the pixel instead of improving the deflection of the liquid crystal molecules, thus degrading the quality of picture, so for each frame of picture, in order to enable at least two times of charging to thereby increase the amounts of charges in the respective rows of storage capacitors, the storage capacitors of the rows of TFTs, which are turned on at the same time shall have the same charge polarities, that is, the M-th row of storage capacitors and the first row of storage capacitors shall have the same charge polarity in this embodiment.

The charge polarities of the respective rows of storage capacitors on the liquid crystal panel are dependent upon a polarity inversion scheme of the liquid crystal panel. As illustrated in FIG. 8, the polarity inversion scheme of the liquid crystal panel generally includes frame polarity inversion, row polarity inversion, column polarity inversion, and dot polarity inversion. FIG. 8 is a diagram of the respective polarity inversion schemes of the liquid crystal panel, where "+" and "−" represent two flip directions of liquid crystal molecules on pixels, or two charge voltage polarities of storage capacitors. As can be apparent from FIG. 8, in the frame polarity inversion scheme, if the respective storage capacitors are charged by positive voltage in the N-th frame, then the respective storage capacitors are charged by negative voltage in the (N+1)-th frame; in the row polarity inversion scheme, if the respective odd-numbered rows of storage capacitors are charged by positive voltage, and the respective even-numbered rows of storage capacitors are charged by negative voltage, in the N-th frame, then the respective odd-numbered rows of storage capacitors are charged by negative voltage, and the respective even-numbered rows of storage capacitors are charged by positive voltage, in the (N+1)-th frame; in the column polarity inversion scheme, the polarities are changed similarly to the row polarity inversion scheme; and in the dot polarity inversion scheme, the charge voltage polarities of the storage capacitors of the adjacent pixels are opposite to each other. As can be apparent from the analysis of FIG. 8, the M-th row on the liquid crystal panel in the frame polarity inversion scheme, the column polarity inversion scheme, and the dot polarity inversion scheme can be any other row than the first row on the liquid crystal panel, and in the row polarity inversion scheme the M-th row on the liquid crystal panel can be any one even-numbered row on the liquid crystal panel, so that the storage capacitors of the rows of TFTs, which are turned on at the same time, have the same charge polarities.

It shall be noted that the voltage across the respective storage capacitors is maintained for a period of time until the next frame of picture arrives, where the period of time in which the voltage is maintained is dependent upon the refresh frequency of the frame of picture. If the refresh frequency of the frame of picture is 60 Hertz (Hz), then the voltage across the storage capacitors may be maintained for approximately (1/60) second (s), i.e., 16.6 milliseconds (ms), so the liquid crystal molecules will be inverted by the voltage for also a period of time, which is 16.6 ms; and for a High-Definition (HD) liquid crystal display with a resolution of 1366*768, if there are 768 active rows, and 38 inactive rows per frame of picture, then there will be 806 rows in total per frame of picture, so that each row may be charged for a period of time, that is, 1/60/806 s, i.e., 20.7 microseconds (μs), which is much shorter than 16.6 ms, so the display of the frame of picture will be affected so insignificantly by the frame of picture varying due to pre-charging that the display of the frame of picture will not be affected by the two times of charging.

As can be apparent from the analysis above, if the same rows of storage capacitors are charged at least twice to thereby prolong the periods of time for which the respective rows of storage capacitors are charged, then some relationship between the flip scheme of the M-th row of liquid crystal molecules and the flip scheme of the first row of liquid crystal molecules will be satisfied according to the polarity inversion scheme of the liquid crystal panel, and the timing controller can determine the M-th row in a number of ways. By way of an example, a counter can be set, and since the period of time for which each row of TFTs is turned on is known, the Tcon can start the timer while outputting the first CPV signal after sending the first STV signal, and can trigger sending of the N-th STV signal when the counter counts up to initial pre-turning-on of the M-th row of TFTs. Alternatively since an occasion on which each row of TFTs is turned on is dependent upon the CPV signal, the Tcon can use a timer to assist in determining an occasion on which the (N+1)-th STV signal is sent. This solution will be described below in details with reference to FIG. 9 by way of an example where a timer is used.

Figure 9:
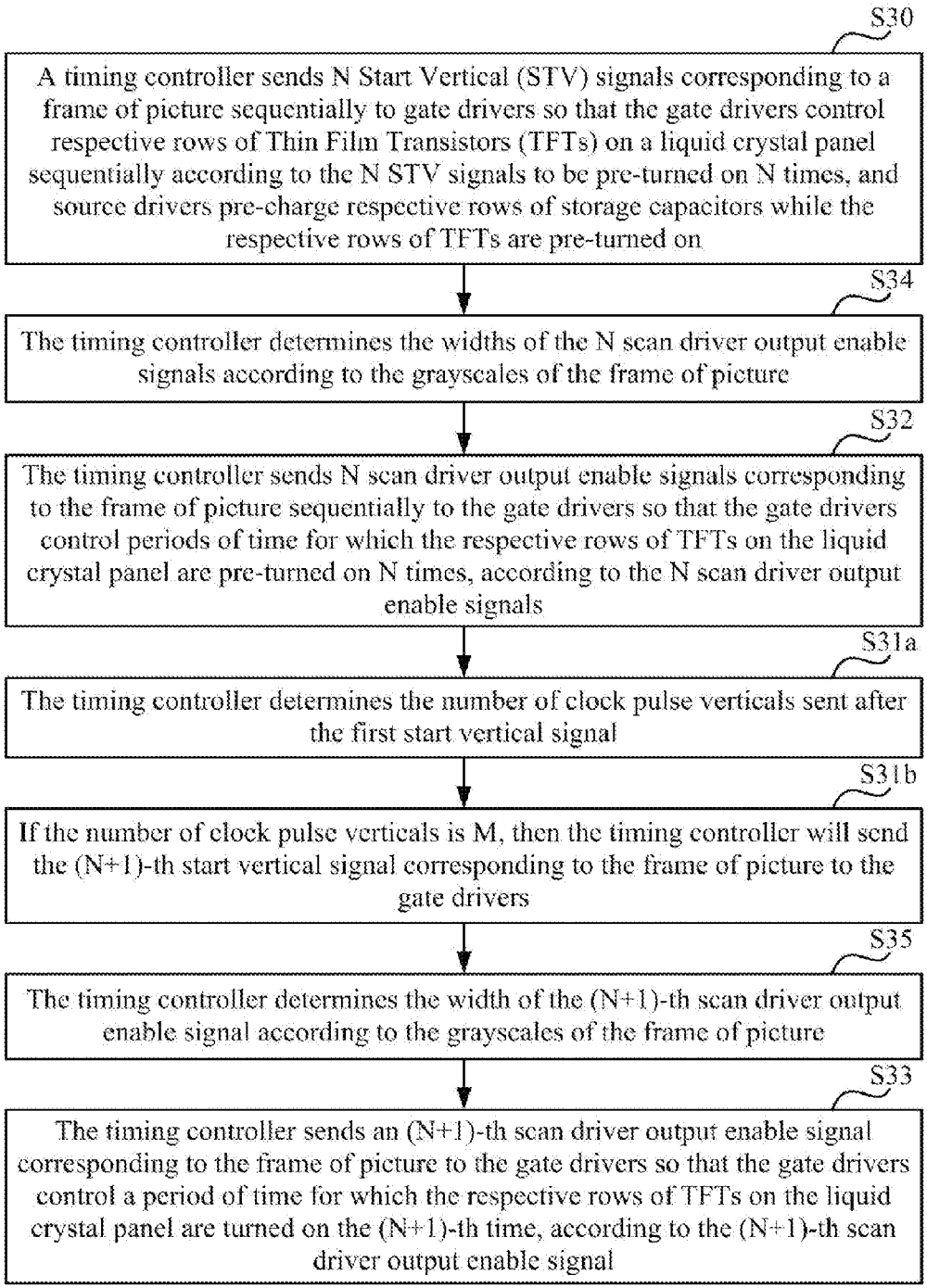
FIG. 9 is a schematic flow chart of a further liquid crystal displaying method according to a fourth embodiment of the disclosure.

FIG. 9 is a schematic flow chart of a further liquid crystal displaying method according to a fourth embodiment of the disclosure. As illustrated in FIG. 9, further to the method illustrated in FIG. 7 above, S31 includes:

S31*a*. The timing controller determines the number of clock pulse verticals (CPVs) sent after the first start vertical signal is sent.

S31*b*. If the number of clock pulse verticals is M, then the timing controller sends the (N+1)-th start vertical signal corresponding to the frame of picture to the gate driver.

In this embodiment, with reference to FIG. 4, by way of an example, if M is 4, then the Tcon can start a counter, after sending the first STV signal to the gate driver, to start counting the number of sent CPV signals, and can send the second STV signal to the gate driver after the counter counts up to 4; and as can be apparent from FIG. 4, upon arrival of the fifth CPV signal, the gate driver output high level drive signals to the fifth rows of TFTs and the first row of TFTs at the same time so that the fifth rows of TFTs and the first row of TFTs are turned on concurrently, and thereafter the respective columns of source driver pre-charges the fifth row of storage capacitors and finally charge the first row of storage capacitors respectively.

Furthermore as can be apparent from FIG. 4, if the refresh frequency of the frame of picture is f, and the total number of rows on the liquid crystal panel is L, then in this liquid crystal displaying method, after final charging of the L-th row of storage capacitors is completed, the total period of time for which the respective rows of storage capacitors corresponding to the frame of picture are charged is more than 1/f; and if the distance between the selected M-th row and the first row is longer, then the total period of time for which respective rows of storage capacitors corresponding to a frame of picture are charged will be longer, and since an interval of time at which two frames of pictures are transmitted is 1/f, if the respective rows of storage capacitors on the liquid crystal panel are charged for a too long period of time while the preceding frame of picture is being transmitted, then the display of the next frame of picture may be affected, so M in the disclosure shall be less than a first ⅓ of the total number of rows on the liquid crystal panel, for example, for an HD-type liquid crystal display, M can be selected less than 256, where there will be a better effect if M is selected less.

With reference to FIG. 8 above, by way of an example, for the liquid crystal display device including the liquid crystal panel for which the inversion scheme is frame polarity inversion, dot polarity inversion or column polarity inversion, M can be 2, 3, 4, etc. If M is selected as 2, then the Tcon sends the second STV signal to the gate driver before the end of pre-turning-on of the first row of TFTs, so that upon arrival of the next CPV, the gate driver outputs high level drive signals to the second row of TFTs and the first row of TFTs at the same time to thereby control the second row of TFTs and the first row of TFTs to be turned on so as to pre-charge the second row of storage capacitors and finally charge the first row of storage capacitors, and so on until the respective rows of storage capacitors throughout the liquid crystal panel are charged twice.

Alternatively as can be apparent from FIG. 8, if the polarity inversion scheme of the liquid crystal panel is row polarity inversion, then the flip directions of the liquid crystal molecules in every other rows on the liquid crystal panel may be the same, so in order to charge the storage capacitors twice to thereby raise the voltage across the storage capacitors, M shall be an even number. Stated otherwise, the Tcon sends the second STV signal to the gate driver before the end of pre-turning-on of any one of the second row, the fourth row, the sixth row, etc., of TFTs, so that upon arrival of the next CPV, the gate driver outputs high level driver signals to any one of the third, the fifth, the seventh, etc., of TFTs, and the first row of TFTs at the same time to control the any one of the third, the fifth, the seventh, etc., of TFTs, and the first row of TFTs to be turned on so as to charge any one of the third, the fifth, the seventh, etc., of storage capacitors and finally charge the first row of storage capacitors, and so on until the respective rows of storage capacitors throughout the liquid crystal panel are charged twice. Alike in order to lower interference between the frames of pictures as much as possible, the M-th row will be preferably selected as such a row that the distance thereof from the first row is shorter, e.g., M=2.

In the liquid crystal displaying method according to this embodiment, the respective rows of storage capacitors on the liquid crystal panel are charged at least twice until a frame of picture is displayed, to thereby prolong the periods of time for which the respective rows of storage capacitors on the liquid crystal panel are charged, so as to make the amounts of charges across the respective rows of storage capacitors satisfactory to the frame of picture to be displayed, as much as possible, thus improving the quality of picture on the liquid crystal display. Moreover the M-th row is selected as such a row that the distance thereof from the first row is shorter, to thereby improve the quality of picture on the liquid crystal display without affecting the display effect between the frames of pictures.

Figure 10:
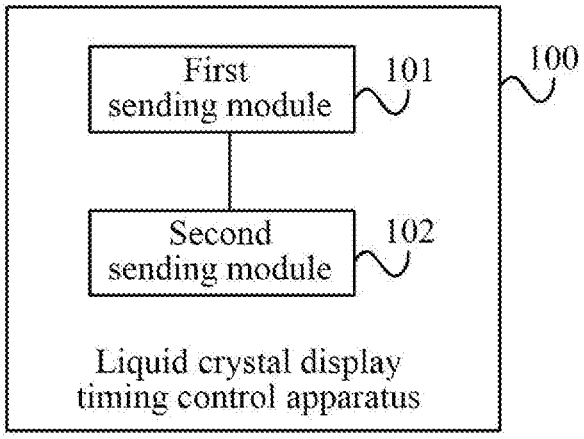
FIG. 10 is a schematic structural diagram of a liquid crystal display timing control apparatus according to a fifth embodiment of the disclosure.

FIG. 10 is a schematic structural diagram of a liquid crystal display timing control apparatus according to a fifth embodiment of the disclosure. As illustrated in FIG. 10, the liquid crystal display timing control apparatus 100 includes a first sending module 101 and a second sending module 102.

Here the first sending module 101 is configured to send N start vertical signals corresponding to a frame of picture sequentially to gate driver so that the gate driver controls respective rows of Thin Film Transistors (TFTs) on a liquid crystal panel sequentially according to the N start vertical signals to be pre-turned on for N times, and source driver pre-charges respective rows of storage capacitors during the respective rows of TFTs are pre-turned on; and The second sending module 102 is configured to send an (N+1)-th start vertical signal corresponding to the frame of picture to the gate driver before an end of the first time pre-turning-on of the M-th row of TFTs on the liquid crystal panel, so that the gate driver control the respective rows of TFTs on the liquid crystal panel according to the (N+1)-th start vertical signal to be turned on sequentially for the (N+1)-th time, so the source driver finally charges the respective rows of storage capacitors during the respective rows of TFTs are turned on the (N+1)-th time, where N and M represent positive integers more than or equal to 1, and less than the total number of rows on the liquid crystal panel.

The liquid crystal display timing control apparatus according to this embodiment includes the Tcon. The liquid crystal display timing control apparatus is connected with a signal source and the liquid crystal panel, and the Tcon in the liquid crystal display timing control apparatus is configured to generate from image information provided by the signal source a control signal, and data signals as required for the liquid crystal panel, for example, to provide the source driver with required TP signals and POL signals, and to provide the gate driver with required CPV signals, STV signals, etc.

In this embodiment, the gate driver start to control the respective rows of TFTs on the liquid crystal panel to be turned on sequentially, upon reception of the STV signal, and the gate driver is driven by the (N+1) STV signals to control the respective rows of TFTs to be cyclically turned on the (N+1) times, where (N+1) turning-on periods of the respective rows of TFTs are intersected and concurrent. During the first N STV signals, the source driver may or may not receive the data signals sent by the Tcon, and the data signals received by the source driver may be real data signals of the frames of pictures, or pre-processed data signals determined by the Tcon according to the grayscales of the frame of picture, or pre-processed data signals determined by the Tcon according to the numbers of times that the respective rows of TFTs are turned on during the respective frame of picture, periods of time for which they are turned on each time, and their real data signals.

The timing controller in this embodiment sends the (N+1) STV signals to the gate driver before each frame of picture is displayed, so that for each frame of picture, the gate driver controls the respective rows of TFTs on the liquid crystal panel to be turned on at least (N+1) times, and the source driver can charge the respective rows of storage capacitors at least (N+1) times, where the source driver pre-charges the respective rows of storage capacitors while the respective rows of TFTs are pre-turned on the first N times, and the source driver finally charges the respective rows of storage capacitors while the respective rows of TFTs are turned on the (N+1)-th time, so that the frame of picture is displayed. The source driver can supplement or correct the amount of charges of the storage capacitors during the source driver finally charges the respective rows of storage capacitors. By way of an example, if the amount of charges in a pre-charged storage capacitor of some pixel on the liquid crystal panel is more than the amount of charges required for the pixel to display the current frame of picture, then the amount of charges in the storage capacitor of the pixel can be discharged by the finally charging source driver so that the amount of charges in the storage capacitor of the pixel will finally be satisfactory to the current frame of picture to be displayed. Correspondingly if the amount of charges in a pre-charged storage capacitor of some pixel on the liquid crystal panel is less than the amount of charges required for the pixel to display the current frame of picture, then the storage capacitor of the pixel can be further charged by the finally charging of source driver so that the amount of charges in the storage capacitor of the pixel finally are satisfactory to the requirement for displaying current frame of picture.

Reference can be made to the detailed description of the liquid crystal displaying method according to the first embodiment above for the functions and the processes of the respective modules in the liquid crystal display timing control apparatus according to this embodiment, so a repeated description thereof will be omitted here.

In the liquid crystal display timing control apparatus according to this embodiment, for each frame of picture, the timing controller firstly sends N STV signals corresponding to the frame of picture to the gate driver, and the gate driver controls the respective rows of TFTs on the liquid crystal panel sequentially according to the N STV signals to be pre-turned on N times; and the timing controller sends the (N+1)-th STV signal of the frame of picture to the gate driver before initial pre-turning-on of the M-th row of TFTs is completed, and the gate driver controls the respective rows of TFTs on the liquid crystal panel sequentially according to the (N+1)-th STV signal to be turned on the (N+1)-th time, so that the source drives finally charges the respective rows of storage capacitors, and also pre-charge the respective rows of storage capacitors of the rows of TFTs, which are pre-turned on, according to the data signals corresponding to the frame of picture. In this liquid crystal display timing control apparatus, the respective rows of storage capacitors on the liquid crystal panel are charged at least twice until the frame of picture is displayed, thus prolonging the periods of time for which the respective rows of storage capacitors on the liquid crystal panel are charged, to thereby make the amounts of charges across the respective rows of storage capacitors satisfactory to the frame of picture to be displayed, as much as possible so as to improve the quality of picture on the liquid crystal display.

Figure 11:
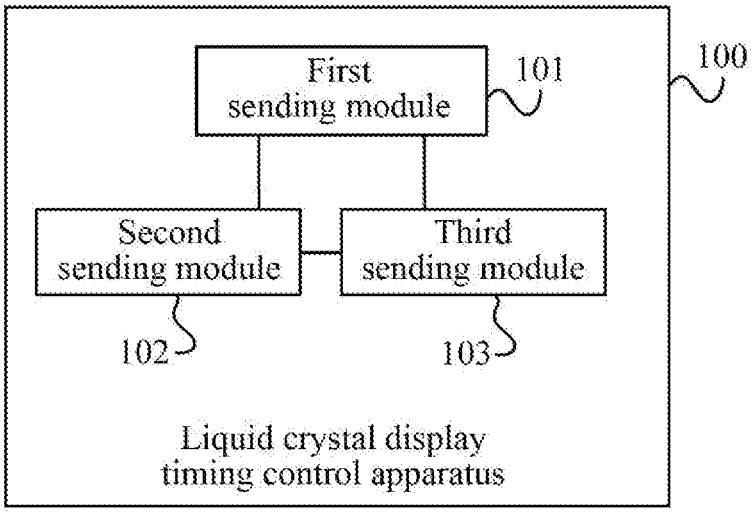
FIG. 11 is a schematic structural diagram of another liquid crystal display timing control apparatus according to a sixth embodiment of the disclosure.

As can be apparent from the analysis above, for each frame of picture, the Tcon controls the respective rows of TFTs on the liquid crystal panel to be turned on at least twice, to thereby prolong the periods of time for which the respective rows of storage capacitors on the liquid crystal panel are charged, and in a real application, after the respective rows of storage capacitors are charged twice, in order to make the final amounts of charges across the respective rows of storage capacitors satisfactory to the frame of picture to be displayed, as much as possible, the amounts of charges in the respective rows of storage capacitors can be further controlled accurately, where the amounts of charges in the storage capacitors can be controlled by controlling the periods of time for which the respective rows of TFTs are turned on each time, and a process of controlling the amounts of charges in the respective rows of storage capacitor by controlling the periods of time for which the respective rows of TFTs are turned on each time will be described below in details with reference to FIG. 11.

FIG. 11 is a schematic structural diagram of another liquid crystal display timing control apparatus according to a sixth embodiment of the disclosure. As illustrated in FIG. 11, further to the apparatus illustrated in FIG. 10 above, the apparatus further includes a third sending module 103 configured to send N scan driver output enable signals corresponding to the frame of picture sequentially to the gate driver so that the gate driver controls periods of time for which the respective rows of TFTs on the liquid crystal panel are pre-turned on N times, according to the N scan driver output enable signals; and to send an (N+1)-th scan driver output enable signal corresponding to the frame of picture to the gate driver so that the gate driver controls a period of time for which the respective rows of TFTs on the liquid crystal panel are turned on the (N+1)-th time, according to the (N+1)-th scan driver output enable signal.

Reference can be made to the detailed description of the liquid crystal displaying method according to the second embodiment above for the functions and the processes of the respective modules in the liquid crystal display timing control apparatus according to this embodiment, so a repeated description thereof will be omitted here.

In the liquid crystal display timing control apparatus according to this embodiment, for each frame of picture, the timing controller firstly sends N STV signals corresponding to the frame of picture to the gate driver, and the gate driver controls the respective rows of TFTs on the liquid crystal panel sequentially according to the N STV signals to be pre-turned on for N times; and thereafter the timing controller sends the (N+1)-th STV signal of the frame of picture to the gate driver before the end of the first time pre-turning-on of the M-th row of TFTs, and the gate driver controls the respective rows of TFTs on the liquid crystal panel sequentially according to the (N+1)-th STV signal to be turned on the (N+1)-th time, so that the source driver finally charges the respective rows of storage capacitors, and also pre-charge the respective rows of storage capacitors of the rows of TFTs, which are pre-turned on, according to the data signals corresponding to the frame of picture. In this liquid crystal display timing control apparatus, the respective rows of storage capacitors on the liquid crystal panel are charged at least twice before the frame of picture is displayed, thus prolonging the periods of time for which the respective rows of storage capacitors on the liquid crystal panel are charged, to thereby make the amounts of charges across the respective rows of storage capacitors satisfactory to the frame of picture to be displayed, as much as possible so as to improve the quality of picture on the liquid crystal display. Moreover the periods of time for which the respective rows of TFTs are turned on each time can be controlled to thereby control the total periods of time for which the respective rows of storage capacitors are charged by the source driver, to thereby make the amounts of charges across the respective rows of storage capacitors more accurate so as to further improve the quality of picture on the liquid crystal display.

Figure 12:
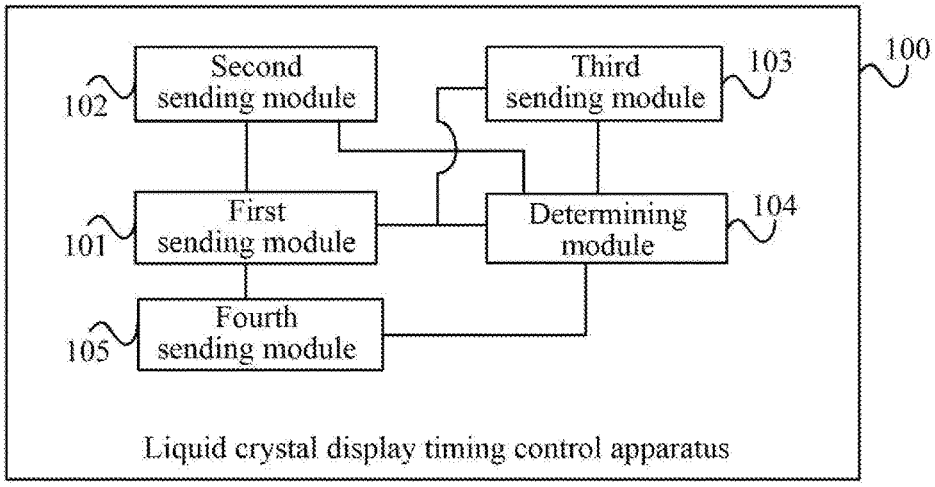
FIG. 12 is a schematic structural diagram of a further liquid crystal display timing control apparatus according to a seventh embodiment of the disclosure.

Furthermore in order to control more precisely the periods of time for which the respective rows of TFTs on the liquid crystal panel are turned on, to thereby control the amounts of charges charged by the source driver onto the respective rows of storage capacitors, so as to make the amounts of charges across the respective rows of storage capacitors satisfactory to the frame of picture, the widths of the OE signals above can be further set according to the grayscales of the respective frame of picture, and a further liquid crystal display timing control apparatus according to an embodiment of the disclosure will be described below with reference to FIG. 12.

FIG. 12 is a schematic structural diagram of a further liquid crystal display timing control apparatus according to a seventh embodiment of the disclosure. As illustrated in FIG. 12, further to the apparatus illustrated in FIG. 11, the liquid crystal display timing control apparatus further includes a determining module 104, where:

The determining module 104 is configured to determine the widths of the N scan driver output enable signals according to the grayscales of the frame of picture; and to determine the width of the (N+1)-th scan driver output enable signal according to the grayscales of the frame of picture.

Particularly the liquid crystal display timing control apparatus can determine the final amounts of charges required in the storage capacitors of the respective pixels on the liquid crystal panel, according to the grayscales of the current frame of picture to thereby set reasonably the widths of the respective OE signals so as to make the amounts of charges in the storage capacitors of the respective pixels consistent with the amounts of charges required to display the frame of picture, as much as possible at the end of pre-charging and final charging.

Moreover as can be apparent from the analysis above, while the (M+1)-th row and the respective succeeding rows of TFTs are pre-turned on, the source driver pre-charges the respective rows of storage capacitors according to the real data signals of the respective rows of TFTs turned on at the same time as the respective rows of TFTs, for example, the pre-charge voltage of the (M+1)-th row is the final charge voltage of the first row, the pre-charge voltage of the (M+2)-th row is the final charge voltage of the second row, etc. Since the Tcon may or may not send the data signals to the source driver before the (N+1)-th STV signal arrives, correspondingly the respective rows of storage capacitors may or may not be pre-charged before the M-th row. In order to enable the respective rows of storage capacitors to be charged at least twice, the liquid crystal display timing control apparatus according to this embodiment further includes a fourth sending module 105 configured to send pre-processed data signals corresponding to the frame of picture to the source driver so that the source driver pre-charges the first M rows of storage capacitors on the liquid crystal panel N times according to the pre-processed data signals, which may or may not be the same as the data signals corresponding to the frame of picture.

In one embodiment, the liquid crystal display timing control apparatus further includes a fifth sending module configured to synchronize data signals corresponding to the frame of picture to the source driver while sending the (N+1)-th STV signal to the gate driver, so that while the (M+1)-th row and the succeeding rows of TFTs are pre-turned on, the source driver pre-charges the respective rows of storage capacitors according to the data signals of rows of TFTs, which are turned on at the same time as the (M+1)-th row and the succeeding rows of TFTs.

The liquid crystal display timing control apparatus according to this embodiment determines the widths of the OE signals according to the grayscales of the current frame of picture to thereby control precisely the amounts of charges in the storage capacitors of the respective pixels so as to further improve the quality of picture on the liquid crystal display.

Moreover as can be apparent from the relevant descriptions of the respective liquid crystal displaying methods above, the second sending module is configured:

To determine the number of clock pulse verticals sent after the first start vertical signal; and If the number of clock pulse verticals is M, then the timing controller will send the (N+1)-th start vertical signal corresponding to the frame of picture to the gate driver.

In this embodiment, with reference to FIG. 4, by way of an example, if M is 4, then the Tcon can start a timer, after sending the first STV signal to the gate driver, to start counting the number of sent CPV signals, and can send the second STV signal to the gate driver after the counter counts up to 4; and as can be apparent from FIG. 4, upon arrival of the fifth CPV signal, the gate driver will output high level drive signals to the fifth rows of TFTs and the first row of TFTs at the same time so that the fifth rows of TFTs and the first row of TFTs are turned on at the same time, and thereafter the respective columns of source driver pre-charge the fifth row of storage capacitors and finally charge the first row of storage capacitors respectively.

Furthermore as can be apparent from FIG. 4, if the refresh frequency of the frame of picture is f, and the total number of rows on the liquid crystal panel is L, then in this liquid crystal display timing control apparatus, after final charging of the L-th row of storage capacitors is completed, the total period of time for which the respective rows of storage capacitors corresponding to the frame of picture are charged is more than 1/f; and if the distance between the selected M-th row and the first row is longer, then the total period of time for which respective rows of storage capacitors corresponding to a frame of picture are charged will be longer, and since an interval of time at which two frames of pictures are transmitted is 1/f, if the respective rows of storage capacitors on the liquid crystal panel are charged for a too long period of time while the preceding frame of picture is being transmitted, then the display of the next frame of picture may be affected, so M in the disclosure shall be less than a first ⅓ of the total number of rows on the liquid crystal panel, for example, for an HD-type liquid crystal display, M can be selected less than 256, where there will be a better effect if M is selected less.

With reference to FIG. 8 above, by way of an example, for the liquid crystal display device including the liquid crystal panel for which the inversion scheme is frame polarity inversion, dot polarity inversion or column polarity inversion, M can be 2, 3, 4, etc. If M is selected as 2, then the Tcon will send the second STV signal to the gate driver before pre-turning-on of the first row of TFTs is completed, so that upon arrival of the next CPV, the gate driver outputs high level drive signals to the second row of TFTs and the first row of TFTs at the same time to thereby control the second row of TFTs and the first row of TFTs to be turned on so as to pre-charge the second row of storage capacitors and finally charge the first row of storage capacitors, and so on until the respective rows of storage capacitors throughout the liquid crystal panel are charged twice.

Alternatively as can be apparent from FIG. 8, if the polarity inversion scheme of the liquid crystal panel is row polarity inversion, then the flip directions of the liquid crystal molecules in every other rows on the liquid crystal panel will be the same, so in order to charge the storage capacitors twice to thereby raise the voltage across the storage capacitors, M shall be an even number. Stated otherwise, the Tcon sends the second STV signal to the gate driver before pre-turning-on of any one of the second row, the fourth row, the sixth row, etc., of TFTs is completed, so that upon arrival of the next CPV, the gate driver outputs high level driver signals to any one of the third, the fifth, the seventh, etc., of TFTs, and the first row of TFTs at the same time to control the any one of the third, the fifth, the seventh, etc., of TFTs, and the first row of TFTs to be turned on so as to charge any one of the third, the fifth, the seventh, etc., of storage capacitors and finally charge the first row of storage capacitors, and so on until the respective rows of storage capacitors throughout the liquid crystal panel are charged twice. Alike in order to lower interference between the frames of pictures as much as possible, the M-th row will be preferably selected as such a row that the distance thereof from the first row is shorter, e.g., M=2.

In the liquid crystal display timing control apparatus according to this embodiment, the respective rows of storage capacitors on the liquid crystal panel are charged at least twice until a frame of picture is displayed, to thereby prolong the periods of time for which the respective rows of storage capacitors on the liquid crystal panel are charged, so as to make the amounts of charges across the respective rows of storage capacitors satisfactory to the frame of picture to be displayed, as much as possible, thus improving the quality of picture on the liquid crystal display. Moreover the M-th row is selected as such a row that the distance thereof from the first row is shorter, to thereby improve the quality of picture on the liquid crystal display without affecting the display effect between the frames of pictures.

Further to the embodiments above, some embodiments of the disclosure further provide a liquid crystal display timing control apparatus including a memory and a processor, where:

One or more program codes are stored in the memory and configured to be executed by the one or more processors. The one or more program codes include instructions for performing the methods as illustrated in FIG. 3 to FIG. 9, and reference can be made to FIG. 3 to FIG. 9 and the descriptions thereof for details of the methods.

Figure 13:
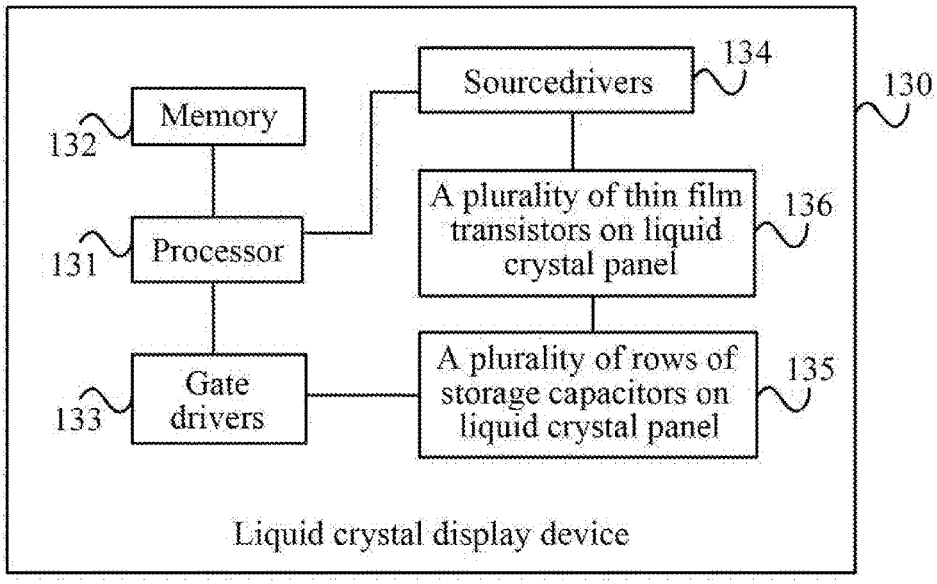
FIG. 13 is a schematic structural diagram of a liquid crystal display device according to an eighth embodiment of the disclosure.

FIG. 13 is a schematic structural diagram of a liquid crystal display timing control apparatus according to an eighth embodiment of the disclosure. As illustrated in FIG. 13, the liquid crystal display device 130 includes a processor 131, a memory 132, a gate driver 133, a source driver 134, and respective rows of Thin Film Transistors (TFTs) 135 on a liquid crystal panel, and respective rows of storage capacitors 136 on the liquid crystal panel.

Here the memory 132 is configured to store program codes;

The processor 131 is configured to execute the program codes stored in the memory 132 to send N start vertical signals corresponding to a frame of picture sequentially to the gate driver 133, and to send an (N+1)-th start vertical signal corresponding to the frame of picture to the gate driver 133 before the end of the first time pre-turning-on of the M-th row of TFTs on the liquid crystal panel;

The gate driver 133 is configured to control respective rows of TFTs 135 on the liquid crystal panel sequentially according to the N start vertical signals to be pre-turned on for N times, and to control the respective rows of TFTs 135 on the liquid crystal panel according to the (N+1)-th start vertical signal to be turned on sequentially for the (N+1)-th time; and The source driver 134 is configured to finally charge the respective rows of storage capacitors during the respective rows of TFTs 135 are turned on for the (N+1)-th time, and to pre-charge the respective rows of storage capacitors 136 during the respective rows of TFTs 135 are pre-turned on, where N and M represent positive integers more than or equal to 1, and less than the total number of rows on the liquid crystal panel.

The processor 131 is further configured to execute the program codes stored in the memory 132 to send N scan driver output enable signals corresponding to the frame of picture sequentially to the gate driver 133 after sending the N start vertical signals corresponding to the frame of picture sequentially to the gate driver 133; and to send an (N+1)-th scan driver output enable signal corresponding to the frame of picture to the gate driver 133 after sending the (N+1)-th start vertical signal corresponding to the frame of picture to the gate driver 133; and The gate driver 133 is further configured to control periods of time for which the respective rows of TFTs 135 on the liquid crystal panel are pre-turned on N times, according to the N scan driver output enable signals, and to control a period of time for which the respective rows of TFTs 135 on the liquid crystal panel are turned on the (N+1)-th time, according to the (N+1)-th scan driver output enable signal.

The processor 131 is further configured to execute the program codes to determine the widths of the N scan driver output enable signals according to the grayscales of the frame of picture; and to determine the width of the (N+1)-th scan driver output enable signal according to the grayscales of the frame of picture.

The processor 131 is configured to determine the number of clock pulse verticals sent after the first start vertical signal is sent, and if the number of clock pulse verticals is M, to send the (N+1)-th start vertical signal corresponding to the frame of picture to the gate driver.

The processor 131 is further configured to execute the program codes to send pre-processed data signals corresponding to the frame of picture to the source driver 134 after sending the N start vertical signals corresponding to the frame of picture sequentially to the gate driver 133; and the source driver 134 is further configured to pre-charge the first M rows of storage capacitors on the liquid crystal panel according to the pre-processed data signals.

The processor 131 is further configured to synchronize data signals corresponding to the frame of picture to the source driver 134 while sending the (N+1)-th STV signal to the gate driver 133; and the source driver 134 is further configured, when the (M+1)-th row and the succeeding rows of TFTs are pre-turned on, to pre-charge each of the (M+1)-th row and the succeeding rows of storage capacitors according to the data signal(s) of one or more rows of TFTs, which are turned on at the same time as each of the (M+1)-th row and the succeeding rows of TFTs.

The processor 131 is further configured to determine the pre-processed data signals corresponding to the frame of picture according to the grayscales of the frame of picture before sending the pre-processed data signals to the source driver 134.

In this embodiment, the program codes stored in the memory includes information about the frames of pictures to be displayed, program for generating the respective start vertical signals corresponding to the frames of pictures, program for generating the clock signal, data information required for the source driver to charge the respective rows of storage capacitors, etc.

While the liquid crystal display device is in use, the processor executes the program stored in the memory to generate the image signals, the start vertical signals sent to the gate driver, the data signals sent to the source driver, etc. The gate driver is controlled by the start vertical signals sent by the processor to control the respective rows of TFTs on the liquid crystal panel sequentially to be turned on, so that the source driver charges the respective rows of storage capacitors on the liquid crystal panel at least twice while the TFTs are turned on.

Reference can be made to the detailed descriptions of the liquid crystal displaying methods according to the first embodiment to the fourth embodiment above for the functions and detailed processes of the respective components of the liquid crystal display according to this embodiment in displaying the frame of picture.

In the liquid crystal display according to this embodiment, for each frame of picture, the timing controller firstly sends N STV signals corresponding to the frame of picture to the gate driver, and the gate driver controls the respective rows of TFTs on the liquid crystal panel sequentially according to the N STV signals to be pre-turned on N times; and thereafter the timing controller sends the (N+1)-th STV signal of the frame of picture to the gate driver before the end of the first time pre-turning-on of the M-th row of TFTs, and the gate driver controls the respective rows of TFTs on the liquid crystal panel sequentially according to the (N+1)-th STV signal to be turned on the (N+1)-th time, so that the source driver finally charges the respective rows of storage capacitors, and also pre-charge the respective rows of storage capacitors of the rows of TFTs, which are pre-turned on, according to the data signals corresponding to the frame of picture. In this liquid crystal display, the respective rows of storage capacitors on the liquid crystal panel are charged at least twice until the frame of picture is displayed, thus prolonging the periods of time for which the respective rows of storage capacitors on the liquid crystal panel are charged, to thereby make the amounts of charges across the respective rows of storage capacitors satisfactory to the frame of picture to be displayed, as much as possible so as to improve the quality of picture on the liquid crystal display.

Those ordinarily skilled in the art can appreciate that all or a part of the steps in the methods according to the embodiments described above can be performed by program instructing relevant hardware, where the program can be stored in a computer readable storage medium, and the program can perform one or a combination of the steps in the method embodiments upon being executed; and the storage medium includes an ROM, an RAM, a magnetic disc, an optical disk, or any other medium which can store program codes.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A liquid crystal display device, comprising:

a processor;

a memory;

a gate driver;

a source driver;

a plurality of rows of Thin Film Transistors (TFTs) positioned on a liquid crystal panel; and a plurality of rows of storage capacitors positioned on the liquid crystal panel, wherein:

the memory is configured to store computer readable program codes;

the processor is configured to execute the computer readable program codes stored in the memory to send N start vertical signals, corresponding to a frame of a picture and configured to control transmission of the frame of the picture, sequentially to the gate driver, to send N scan driver output enable signals corresponding to the frame of the picture sequentially to the gate driver after sending the N start vertical signals corresponding to the frame of picture sequentially to the gate driver, to send an (N+1)-th start vertical signal corresponding to the frame of the picture to the gate driver before an end of a first pre-turn-on time period of an M-th one of the plurality of rows of TFTs positioned on the liquid crystal panel, and to send an (N+1)-th scan driver output enable signal corresponding to the frame of picture to the gate driver after sending the (N+1)-th start vertical signal corresponding to the frame of picture to the gate driver;

the gate driver is configured to pre-turn-on each of the plurality of rows of TFTs on the liquid crystal panel sequentially N times according to the N start vertical signals and clock pulse vertical (CPV) signals corresponding to pulses of the N start vertical signals, the CPV signals configured to turn on each of the plurality of rows of TFTs, to control periods of time for which each of the plurality of rows of TFTs positioned on the liquid crystal panel is pre-turned on sequentially N times, according to widths of the N scan driver output enable signals, to turn on each of the plurality of rows of TFTs positioned on the liquid crystal panel sequentially for the (N+1)-th time according to the (N+1)-th start vertical signal and a CPV signal corresponding to a pulse of the (N+1)-th start vertical signal, and to control a period of time for which each of the plurality of rows of TFTs positioned on the liquid crystal panel is turned on for the (N+1)-th time, according to a width of the (N+1)-th scan driver output enable signal; and the source driver is configured to finally charge each of the plurality of rows of storage capacitors when each of the plurality of rows of TFTs is turned on for the (N+1)-th time, and to pre-charge each of the plurality of rows of storage capacitors when each of the plurality of rows of TFTs is pre-turned on, wherein N and M represent positive integers greater than or equal to 1, and less than a total number of rows on the liquid crystal panel.

2. The device according to claim 1, wherein the processor is further configured to execute the computer readable program codes to determine the widths of the N scan driver output enable signals according to grayscales of the frame of the picture, and to determine the width of the (N+1)-th scan driver output enable signal according to the grayscales of the frame of the picture.

3. The device according to claim 1, wherein the processor is further configured to execute the computer readable program codes to determine a number of clock pulse verticals sent after the first start vertical signal is sent, and when the number of clock pulse verticals is M, to send the (N+1)-th start vertical signal corresponding to the frame of picture to the gate driver.

4. The device according to claim 1, wherein the processor is further configured to execute the program codes to send pre-processed data signals corresponding to the frame of the picture to the source driver after sending the N start vertical signals corresponding to the frame of the picture sequentially to the gate driver; and the source driver is further configured to pre-charge the first M rows of storage capacitors positioned on the liquid crystal panel according to the pre-processed data signals.

5. The device according to claim 1, wherein the processor is further configured to synchronize data signals corresponding to the frame of the picture to the source driver while sending the (N+1)-th STV signal to the gate driver; and the source driver is further configured, when each of the (M+1)-th row and the succeeding rows of TFTs is pre-turned on, to pre-charge each of the (M+1)-th row and the succeeding rows of storage capacitors according to the data signal of a row of TFTs that is turned on at the same time as each of the (M+1)-th row and the succeeding rows of TFTs.

6. The device according to claim 4, wherein the processor is further configured to determine the pre-processed data signals corresponding to the frame of picture according to grayscales of the frame of the picture before sending the pre-processed data signals to the source driver.

7. The device according to claim 6, wherein a polarity inversion scheme of the liquid crystal panel is row polarity inversion; and M is an even number.

8. The device according to claim 4, wherein M is less than ⅓ of the total number of rows on the liquid crystal panel.

9. A liquid crystal displaying method, comprising:

sending, by a timing controller, N start vertical signals, corresponding to a frame of a picture and configured to control transmission of the frame of the picture, sequentially to a gate driver so that the gate driver pre-turns-on each of a plurality of rows of Thin Film Transistors (TFTs) positioned on a liquid crystal panel sequentially N times according to the N start vertical signals and clock pulse vertical (CPV) signals corresponding to pulses of the N start vertical signals, the CPV signals configured to turn on each of the plurality of rows of TFTs, and a source driver pre-charges each of a plurality of rows of storage capacitors when each of the plurality of rows of TFTs is pre-turned on;

sending, by the timing controller, N scan driver output enable signals corresponding to the frame of the picture sequentially to the gate driver so the gate driver controls periods of time for which each of the plurality of rows of TFTs positioned on the liquid crystal panel is pre-turned on for N times, according to widths of the N scan driver output enable signals;

sending, by the timing controller, an (N+1)-th start vertical signal corresponding to the frame of the picture to the gate driver before an end of a first pre-turn-on time period of an M-th one of the plurality of rows of TFTs positioned on the liquid crystal panel, so that the gate driver turns on each of the plurality of rows of TFTs positioned on the liquid crystal panel sequentially for the (N+1)-th time according to the (N+1)-th start vertical signal and a CPV signal corresponding to a pulse of the (N+1)-th start vertical signal, so the source driver finally charges each of the plurality of rows of storage capacitors when each of the plurality of rows of TFTs is turned on for the (N+1)-th time, wherein N and M represent positive integers greater than or equal to 1, and less than a total number of rows on the liquid crystal panel; and sending, by the timing controller, an (N+1)-th scan driver output enable signal corresponding to the frame of the picture to the gate driver so the gate driver controls a period of time for which each of the plurality of rows of TFTs positioned on the liquid crystal panel is turned on for the (N+1)-th time, according to a width of the (N+1)-th scan driver output enable signal.

10. The method according to claim 9, wherein before the timing controller sends the N scan driver output enable signals corresponding to the frame of the picture sequentially to the gate driver, the method further comprises:

determining, by the timing controller, the widths of the N scan driver output enable signals according to grayscales of the frame of picture; and before the timing controller sends the (N+1)-th scan driver output enable signal corresponding to the frame of picture to the gate driver, the method further comprises:

determining, by the timing controller, the width of the (N+1)-th scan driver output enable signal according to the grayscales of the frame of picture.

11. The method according to claim 9, wherein sending, by the timing controller, the (N+1)-th STV signal corresponding to the frame of the picture to the gate driver before the end of the first pre-turn-on time period of the M-th row of TFTs positioned on the liquid crystal panel comprises:

determining, by the timing controller, a number of clock pulse verticals sent after the first start vertical signal is sent; and when the number of clock pulse verticals is M, then sending, by the timing controller, the (N+1)-th start vertical signal corresponding to the frame of the picture to the gate driver.

12. The method according to claim 9, wherein after the timing controller sends the N scan driver output enable signals corresponding to the frame of the picture sequentially to the gate driver, the method further comprises:

sending, by the timing controller, pre-processed data signals corresponding to the frame of the picture to the source driver so that the source driver pre-charges the first M rows of storage capacitors positioned on the liquid crystal panel according to the pre-processed data signals.

13. The method according to claim 9, wherein for the frame of the picture, a number of the start vertical signals is equal to a sum of a number of times pre-charging any one of the plurality of rows of storage capacitors and a number of times finally charging said any one of the plurality of rows of storage capacitors.

14. A liquid crystal displaying method, comprising:

sending, by a timing controller, N start vertical signals, corresponding to a frame of a picture, sequentially to a gate driver so that the gate driver pre-turns-on each of a plurality of rows of Thin Film Transistors (TFTs) positioned on a liquid crystal panel sequentially according to the N start vertical signals, and a source driver pre-charges each of a plurality of rows of storage capacitors when each of the plurality of rows of TFTs is pre-turned on; and sending, by the timing controller, an (N+1)-th start vertical signal corresponding to the frame of the picture to the gate driver before an end of a first pre-turn-on time period of an M-th one of the plurality of rows of TFTs on the liquid crystal panel, so that the gate driver turns on each of the plurality of rows of TFTs positioned on the liquid crystal panel sequentially for the (N+1)-th time according to the (N+1)-th start vertical signal, so the source driver charges each of the plurality of rows of storage capacitors when each of the plurality of rows of TFTs is turned on for the (N+1)-th time, wherein N and M represent positive integers greater than or equal to 1, and less than the total number of rows on the liquid crystal panel;

after the timing controller sends the N start vertical signals corresponding to the frame of the picture sequentially to the gate driver, sending, by the timing controller, N scan driver output enable signals corresponding to the frame of the picture sequentially to the gate driver so that the gate driver controls periods of time for which each of the plurality of rows of TFTs on the liquid crystal panel is pre-turned on for N times, according to the N scan driver output enable signals, and sending, by the timing controller, an (N+1)-th scan driver output enable signal corresponding to the frame of the picture to the gate driver so that the gate driver controls a period of time for which each of the plurality of rows of TFTs on the liquid crystal panel is turned on for the (N+1)-th time, according to the (N+1)-th scan driver output enable signal;

before the timing controller sends the N scan driver output enable signals corresponding to the frame of picture sequentially to the gate driver, determining, by the timing controller, widths of the N scan driver output enable signals according to grayscales of the frame of picture; and before the timing controller sends the (N+1)-th scan driver output enable signal corresponding to the frame of picture to the gate driver, determining, by the timing controller, the width of the (N+1)-th scan driver output enable signal according to the grayscales of the frame of picture.

15. The method according to claim 14, wherein sending, by the timing controller, the (N+1)-th SW signal corresponding to the frame of the picture to the gate driver before the end of the first pre-turn-on time period of the M-th row of TFTs positioned on the liquid crystal panel comprises:

recording, by the timing controller, a number of clock pulse verticals sent after the first start vertical signal is sent; and when the number of clock pulse verticals is M, then sending, by the timing controller, the (N+1)-th start vertical signal corresponding to the frame of the picture to the gate driver.

16. The method according to claim 14, wherein after the timing controller sends the N scan driver output enable signals corresponding to the frame of the picture sequentially to the gate driver, the method further comprises:

sending, by the timing controller, pre-processed data signals corresponding to the frame of picture to the source driver so that the source driver pre-charges the first M rows of storage capacitors positioned on the liquid crystal panel according to the pre-processed data signals.

17. The method according to claim 14, wherein for the frame of the picture, a number of the start vertical signals is equal to a sum of a number of times pre-charging any one of the plurality of rows of storage capacitors and a number of times of finally charging said any one of the plurality of rows of storage capacitors.

* * * * *